US008628656B2

(12) United States Patent
Podrebarac et al.

(10) Patent No.: US 8,628,656 B2
(45) Date of Patent: Jan. 14, 2014

(54) HYDRODESULFURIZATION PROCESS WITH SELECTED LIQUID RECYCLE TO REDUCE FORMATION OF RECOMBINANT MERCAPTANS

(75) Inventors: Gary G. Podrebarac, League City, TX (US); Mahesh Subramanyam, Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 576 days.

(21) Appl. No.: 12/862,845

(22) Filed: Aug. 25, 2010

(65) Prior Publication Data

US 2012/0048776 A1 Mar. 1, 2012

(51) Int. Cl.
*C10G 45/00* (2006.01)

(52) U.S. Cl.
USPC ..... 208/208 R; 208/209; 208/210; 208/213; 208/216 R; 208/217; 208/244

(58) Field of Classification Search
USPC ..... 208/208 R, 209, 210, 213, 216 R, 217, 208/244
See application file for complete search history.

(56) References Cited

U.S. PATENT DOCUMENTS

| | | | |
|---|---|---|---|
| 2,793,170 | A | 5/1957 | Stiles et al. |
| 4,397,739 | A | 8/1983 | Jacquin et al. |
| 4,731,229 | A | 3/1988 | Sperandio |
| 5,073,236 | A | 12/1991 | Gelbein et al. |
| 5,266,546 | A | 11/1993 | Hearn |
| 5,431,890 | A | 7/1995 | Crossland et al. |
| 5,510,568 | A | 4/1996 | Hearn |
| 5,595,634 | A | 1/1997 | Hearn et al. |
| 5,595,643 | A | 1/1997 | Torimoto et al. |
| 5,597,476 | A | 1/1997 | Hearn et al. |
| 5,730,843 | A | 3/1998 | Groten et al. |

(Continued)

FOREIGN PATENT DOCUMENTS

| | | | |
|---|---|---|---|
| CN | 101570698 | A | 11/2009 |
| WO | 01/59032 | A1 | 8/2001 |

OTHER PUBLICATIONS

Notification of Transmittal of the International Search Report and the Written Opinion of the International Searching Authority issued Feb. 29, 2012 in corresponding International Application No. PCT/US2011/039431 (8 pages).

(Continued)

*Primary Examiner* — Prem C Singh
*Assistant Examiner* — Michelle Stein
(74) *Attorney, Agent, or Firm* — Osha • Liang LLP

(57) ABSTRACT

Processes for the desulfurization of a cracked naphtha by the reaction of hydrogen with the organic sulfur compounds present in the feed are disclosed. In particular, processes disclosed herein may use one or more catalytic distillation steps followed by further hydrodesulfurization of the naphtha in a fixed bed reactor. It has been found that the formation of recombinant mercaptans in the fixed bed reactor effluent may be reduced or eliminated by reducing the concentration of hydrogen sulfide and/or olefins at the exit of the fixed bed reactor. The reduction or elimination in the formation of recombinant mercaptans may be accomplished by recycling a select portion of the fixed bed reactor effluent to the fixed bed reactor, where the select portion has a relatively low or nil concentration of olefins. Processes disclosed herein may thus facilitate the production of hydrodesulfurized cracked naphthas having a total sulfur content of less than 10 ppm, by weight.

28 Claims, 6 Drawing Sheets

(56) References Cited

U.S. PATENT DOCUMENTS

| | | | | |
|---|---|---|---|---|
| 5,779,883 | A | 7/1998 | Hearn et al. | |
| 5,837,130 | A | 11/1998 | Crossland | |
| 6,083,378 | A | 7/2000 | Gildert et al. | |
| 6,303,020 | B1 | 10/2001 | Podrebarac et al. | |
| 6,338,793 | B1 | 1/2002 | Putman | |
| 6,409,913 | B1 | 6/2002 | Clark et al. | |
| 6,413,413 | B1 | 7/2002 | Smith, Jr. | |
| 6,416,658 | B1 | 7/2002 | Maraschino et al. | |
| 6,444,118 | B1 * | 9/2002 | Podrebarac et al. | 208/210 |
| 6,495,030 | B1 | 12/2002 | Podrebarac | |
| 6,503,864 | B2 | 1/2003 | Loescher et al. | |
| 6,592,750 | B2 | 7/2003 | Podrebarac et al. | |
| 6,678,830 | B1 | 1/2004 | Mustafa et al. | |
| 6,736,962 | B1 | 5/2004 | Cook et al. | |
| 6,824,676 | B1 | 11/2004 | Podrebarac et al. | |
| 6,824,679 | B1 | 11/2004 | Dzengeleski et al. | |
| 6,946,068 | B2 | 9/2005 | Groten | |
| 6,984,312 | B2 | 1/2006 | Som et al. | |
| 7,153,415 | B2 | 12/2006 | Podrebarac et al. | |
| 7,291,258 | B2 | 11/2007 | Podrebarac et al. | |
| 7,351,327 | B2 | 4/2008 | Podrebarac et al. | |
| 7,431,827 | B2 | 10/2008 | Rock et al. | |
| 2001/0047952 | A1 * | 12/2001 | Podrebarac et al. | 208/210 |
| 2004/0195151 | A1 * | 10/2004 | Podrebarac et al. | 208/210 |
| 2007/0095725 | A1 * | 5/2007 | Podrebarac et al. | 208/209 |
| 2009/0188837 | A1 | 7/2009 | Podrebarac | |

OTHER PUBLICATIONS

Notification of Transmittal of the International Preliminary Report on Patentability issued May 23, 2013 in corresponding International Application No. PCT/US2011/056627 (6 pages).

First Office Action issued Jul. 10, 2013 in corresponding Chinese application No. 201110245132.7 (11 pages).

* cited by examiner

HYDRODESULFURIZATION PROCESS WITH SELECTED LIQUID RECYCLE TO REDUCE FORMATION OF RECOMBINANT MERCAPTANS

FIELD OF THE DISCLOSURE

Embodiments disclosed here generally relate to processes for the hydrodesulfurization of FCC naptha. More particularly, embodiments disclosed herein relate to processes for the hydrodesulfurization of FCC naptha to produce gasoline fractions having low or undetectable mercaptan content.

BACKGROUND OF THE DISCLOSURE

Petroleum distillate streams contain a variety of organic chemical components. Generally the streams are defined by their boiling ranges, which determine the composition. The processing of the streams also affects the composition. For instance, products from either catalytic cracking or thermal cracking processes contain high concentrations of olefinic materials as well as saturated (alkanes) materials and polyunsaturated materials (diolefins). Additionally, these components may be any of the various isomers of the compounds.

The composition of untreated naphtha as it comes from the crude still, or straight run naphtha, is primarily influenced by the crude source. Naphthas from paraffinic crude sources have more saturated straight chain or cyclic compounds. As a general rule most of the "sweet" (low sulfur) crudes and naphthas are paraffinic. The naphthenic crudes contain more unsaturates, cyclic, and polycylic compounds. The higher sulfur content crudes tend to be naphthenic. Treatment of the different straight run naphthas may be slightly different depending, upon their composition due to crude source.

Reformed naphtha or reformate generally requires no further treatment except perhaps distillation or solvent extraction for valuable aromatic product removal. Reformed naphthas have essentially no sulfur contaminants due to the severity of their pretreatment for the process and the process itself.

Cracked naphtha, as it comes from the catalytic cracker, has a relatively high octane number as a result of the olefinic and aromatic compounds contained therein. In some cases, this fraction may contribute as much as half of the gasoline in the refinery pool together with a significant portion of the octane.

Catalytically cracked naphtha gasoline boiling range material currently forms a significant part (~⅓) of the gasoline product pool in the United States and is the cause of the majority of the sulfur found in gasoline. These sulfur impurities may require removal in order to comply with product specifications or to ensure compliance with environmental regulations, which may be as low as 10, 20 or 50 wppm, depending upon the jurisdiction.

The most common method of removal of the sulfur compounds is by hydrodesulfurization (HDS) in which the petroleum distillate is passed over a solid particulate catalyst comprising a hydrogenation metal supported on an alumina base. Additionally, large amounts of hydrogen are included in the feed. The hydrodesulfurization reaction results in the production of hydrogen sulfide according to the following reaction: $RSH+H_2 \leftrightarrow R'+H_2S$. Typical operating conditions for standard single pass fixed bed HDS reactors, such as in a trickle bed reactor, are temperatures ranging from 600° F. to 780° F., pressures ranging from 300 to 3000 psig, hydrogen recycle rates ranging from 500 to 3000 scf/bbl, and fresh hydrogen makeup ranging from 100 to 1000 scf/bbl.

After the hydrotreating is complete, the product may be fractionated or simply flashed to release the hydrogen sulfide and collect the desulfurized naphtha. In addition to supplying high octane blending components the cracked naphthas are often used as sources of olefins in other processes such as etherifications, oligomerizations, and alkylations. The conditions used to hydrotreat the naphtha fraction to remove sulfur will also saturate some of the olefinic compounds in the fraction, reducing the octane and causing a loss of source olefins. The loss of olefins by incidental hydrogenation is detrimental, reducing the octane rating of the naphtha and reducing the pool of olefins for other uses.

Various proposals have been made for removing sulfur while retaining the more desirable olefins. Because the olefins in the cracked naphtha are mainly in the low boiling fraction of these naphthas and the sulfur containing impurities tend to be concentrated in the high boiling fraction, the most common solution has been prefractionation prior to hydrotreating. The prefractionation produces a light boiling range naphtha which boils in the range of $C_5$ to about 150° F. and a heavy boiling range naphtha which boils in the range of from about 150-475° F.

The predominant light or lower boiling sulfur compounds are mercaptans while the heavier or higher boiling compounds are thiophenes and other heterocyclic compounds. The separation by fractionation alone will not remove the mercaptans. However, in the past the mercaptans have been removed by oxidative processes involving caustic washing. A combination of oxidative removal of the mercaptans followed by fractionation and hydrotreating of the heavier fraction is disclosed in U.S. Pat. No. 5,320,742. In the oxidative removal of the mercaptans the mercaptans are converted to the corresponding disulfides.

Several U.S. patents describe the concurrent distillation and desulfurization of naphtha, including U.S. Pat. Nos. 5,597,476; 5,779,883; 6,083,378; 6,303,020; 6,416,658; 6,444,118; 6,495,030; 6,678,830 and 6,824,679. In each of these patents, the naphtha is split into two or three fractions based upon boiling point or boiling ranges.

An additional problem encountered during hydrodesulfurization is the reaction of hydrogen sulfide with olefins to form what are called recombinant mercaptans:

$$H_2S+RC{=}CR' \leftrightarrow RC{-}CR'SH+R(SH)C{-}CR'.$$

The formation of mercaptans during the hydrodesulfurization of FCC gasoline is well known to occur, as disclosed in U.S. Pat. No. 2,793,170. Recombinant mercaptans may form due to the relatively high concentration of hydrogen sulfide in the flash or overhead system (compared to the concentration of hydrogen sulfide within a reactive distillation column). A very important consideration in hydrodesulfurization designs is managing the amount of these recombinant mercaptans in the product.

U.S. Pat. No. 6,409,913 discloses a process to desulfurize naphtha by reacting a naphtha feed containing sulfur compounds and olefins with hydrogen in the presence of a hydrodesulfurization catalyst. As described therein, reduced recombinant mercaptan formation may be achieved at specific conditions of high temperature, low pressure, and high treat gas ratio. Although not discussed in relation to the desired high temperature, vaporization of FCC streams may result in plugging of heat exchangers and flow lines due to the polymerization of olefins, as described in U.S. Pat. No. 4,397,739.

In U.S. Pat. No. 6,416,658, a full boiling range naphtha stream is subjected to simultaneous hydrodesulfurization and splitting into a light boiling range naphtha and a heavy boiling range naphtha followed by a further hydrodesulfurization by contacting the light boiling range naphtha with hydrogen in countercurrent flow in a fixed bed of hydrodesulfurization catalyst to remove recombinant mercaptans which are formed by the reverse reaction of $H_2S$ with olefins in the naphtha during the initial hydrodesulfurization. In particular the entire recovered portion of the light naphtha from a reaction distillation column hydrodesulfurization is further contacted with hydrogen in countercurrent flow in a fixed bed of hydrodesulfurization catalyst.

U.S. Pat. No. 6,303,020 discloses a process to desulfurize naphtha by first reacting a naphtha feed containing sulfur compounds and olefins with hydrogen in the presence of a hydrodesulfurization catalyst, followed by contact of the naphtha with hydrogen in a "polishing" reactor to remove further sulfur compounds.

SUMMARY OF THE CLAIMED EMBODIMENTS

Embodiments disclosed herein relate to the desulfurization of a cracked naphtha by the reaction of hydrogen with the organic sulfur compounds present in the feed. In particular, the present invention may use one or more catalytic distillation steps followed by further hydrodesulfurization of the naphtha in a fixed bed reactor.

It has been found that the formation of recombinant mercaptans in the fixed bed reactor effluent may be reduced or eliminated by reducing the concentration of hydrogen sulfide and/or olefins at the exit of the fixed bed reactor. The reduction or elimination in the formation of recombinant mercaptans may thus facilitate the production of hydrodesulfurized cracked naphthas having a total sulfur content of less than 10 ppm, by weight.

In one aspect, embodiments disclosed herein relate to a process for the hydrodesulfurization of a cracked naphtha, the process including: feeding a cracked naphtha to a fixed bed single pass reaction zone having an inlet and an outlet and containing a hydrodesulfurization catalyst, wherein a portion of the organic sulfur compounds in the cracked naphtha are reacted with hydrogen to produce $H_2S$; recovering an effluent from the fixed bed single pass reaction zone via the outlet and feeding the effluent to a separation zone to remove $H_2S$ therefrom and to recover a stripped effluent; feeding the stripped effluent to a fractionator to separate the stripped effluent into a light fraction and a heavy fraction having an ASTM D-86 initial boiling point within 30° F. of a temperature at which an analysis of the stripped effluent indicates a maximum rate of decline on a bromine number—temperature plot; recovering the light fraction as an overheads from the fractionator; recovering the heavy fraction as a bottoms from the fractionator; recycling at least a portion of the heavy fraction to the fixed bed single pass reaction zone, wherein a ratio of recycled heavy fraction to the cracked naphtha fed to the fixed bed single pass reaction zone is in the range from about 0.25:1 to about 10:1. In some embodiments, the heavy fraction recycled may have an ASTM D-86 initial boiling point of at least 250° F.

In another aspect, embodiments disclosed herein relate to a process for the hydrodesulfurization of a cracked naphtha stream, the process including: feeding hydrogen and a cracked naphtha stream containing organic sulfur compounds and olefins to a distillation column reactor containing a hydrodesulfurization catalyst; concurrently in the distillation column reactor; (1) contacting the cracked naphtha and the hydrogen with the hydrodesulfurization catalyst to react a portion of the organic sulfur compounds with the hydrogen to form $H_2S$; and (2) separating the cracked naphtha into a light fraction and a heavy fraction; removing the light fraction as overheads from the distillation column reactor along with $H_2S$ and unreacted hydrogen; separating the light fraction from the $H_2S$ and unreacted hydrogen; removing the heavy fraction as bottoms from the distillation column reactor; feeding the heavy fraction and the light fraction to a first separation zone to remove $H_2S$ therefrom and to recover a stripped combined fraction; feeding at least a portion of the stripped combined fraction to a fixed bed single pass reaction zone having an inlet and an outlet and containing a hydrodesulfurization catalyst, wherein a portion of the remaining organic sulfur compounds in the stripped combined fraction are reacted with hydrogen to produce $H_2S$; recovering an effluent from the fixed bed single pass reaction zone via the outlet and feeding the effluent to a second separation zone to remove $H_2S$ therefrom and to recover a stripped effluent; feeding the stripped effluent to a fractionator to separate the stripped effluent into a light fraction and a heavy fraction having an ASTM D-86 initial boiling point within 30° F. of a temperature at which an analysis of the stripped effluent indicates a maximum rate of decline on a bromine number—temperature plot; recovering the light fraction as an overheads from the fractionator; recovering the heavy fraction as a bottoms from the fractionator; recycling at least a portion of the heavy fraction to the fixed bed single pass reaction zone, wherein a ratio of recycled heavy fraction to the cracked naphtha fed to the fixed bed single pass reaction zone is in the range from about 0.25:1 to about 10:1.

In another aspect, embodiments disclosed herein relate to a process for the hydrodesulfurization of a cracked naphtha stream, the process including: feeding hydrogen and a cracked naphtha stream containing organic sulfur compounds and olefins to a distillation column reactor containing a hydrodesulfurization catalyst; concurrently in the distillation column reactor; (1) contacting the cracked naphtha and the hydrogen with the hydrodesulfurization catalyst to react a portion of the organic sulfur compounds with the hydrogen to form $H_2S$; and (2) separating the cracked naphtha into a light fraction and a heavy fraction; removing the light fraction as overheads from the distillation column reactor along with $H_2S$ and unreacted hydrogen; separating the light fraction from the $H_2S$ and unreacted hydrogen; removing the heavy fraction as bottoms from the distillation column reactor; feeding the heavy fraction and the light fraction to a first separation zone to remove $H_2S$ therefrom and to recover a stripped combined fraction; withdrawing a liquid fraction from the distillation column reactor as a side draw and feeding the liquid fraction to a fixed bed single pass reaction zone having an inlet and an outlet and containing a hydrodesulfurization catalyst, wherein a portion of the remaining organic sulfur compounds in the liquid fraction are reacted with hydrogen to produce $H_2S$; recovering an effluent from the fixed bed single pass reaction zone via the outlet and feeding the effluent to a second separation zone to remove $H_2S$ therefrom and to recover a stripped effluent; feeding the stripped effluent to a fractionator to separate the stripped effluent into a light fraction and a heavy fraction having an ASTM D-86 initial boiling point within 30° F. of a temperature at which an analysis of the stripped effluent indicates a maximum rate of decline on a bromine number—temperature plot; recovering the light fraction as an overheads from the fractionator; recovering the heavy fraction as a bottoms from the fractionator; recycling at least a portion of the heavy fraction to the fixed bed single pass reaction zone, wherein a ratio of recycled heavy fraction to the cracked naphtha fed to the fixed bed single pass reaction zone is in the range from about 0.25:1 to about 10:1.

In another aspect, embodiments disclosed herein relate to a process for the hydrodesulfurization of a cracked naphtha stream, the process including: feeding (1) a full boiling range cracked naphtha containing olefins, diolefins, mercaptans and other organic sulfur compounds and (2) hydrogen to a first catalytic distillation reactor system; concurrently in the first catalytic distillation reactor system, (i) contacting the diolefins and the mercaptans in the cracked naphtha in the presence of a Group VIII metal catalyst in the rectification section of the first catalytic distillation reactor system thereby reacting: (A) a portion of the mercaptans with a portion of the diolefins to form thioethers, (B) a portion of the mercaptans with a portion of the hydrogen to form hydrogen sulfide; or (C) a portion of the dienes with a portion of the hydrogen to form olefins; or (D) a combination of one or more of (A), (B), and (C); and (ii) fractionating the full boiling range cracked naphtha into a distillate product containing C5 hydrocarbons and a first heavy naphtha containing sulfur compounds; recovering the first heavy naphtha from the first catalytic distillation reactor system as a first bottoms; feeding the first bottoms and hydrogen to a second catalytic distillation reactor system having one or more reaction zones containing a hydrodesulfurization catalyst; concurrently in the second catalytic distillation reactor system, (i) reacting at least a portion of the mercaptans and other organic sulfur compounds in the first bottoms with hydrogen in the presence of the hydrodesulfurization catalyst to convert a portion of the mercaptans and other organic sulfur compounds to hydrogen sulfide, and (ii) separating the first bottoms into a light naphtha fraction and a heavy naphtha fraction; recovering the light naphtha fraction, unreacted hydrogen, and hydrogen sulfide from the second catalytic distillation reactor system as an overheads vapor fraction; separating the light naphtha fraction from the $H_2S$ and unreacted hydrogen; recovering the heavy naphtha fraction from the second catalytic distillation reactor system as a bottoms fraction; feeding the heavy naphtha fraction and the light naphtha fraction to a first separation zone to remove $H_2S$ therefrom and to recover a stripped combined fraction; feeding at least a portion of the stripped combined fraction to a fixed bed single pass reaction zone having an inlet and an outlet and containing a hydrodesulfurization catalyst, wherein a portion of the remaining organic sulfur compounds in the stripped combined fraction are reacted with hydrogen to produce $H_2S$; recovering an effluent from the fixed bed single pass reaction zone via the outlet and feeding the effluent to a second separation zone to remove $H_2S$ therefrom and to recover a stripped effluent; and feeding the stripped effluent to a fractionator to separate the stripped effluent into a light fraction and a heavy fraction having an ASTM D-86 initial boiling point within 30° F. of a temperature at which an analysis of the stripped effluent indicates a maximum rate of decline on a bromine number—temperature plot; recovering the light fraction as an overheads from the fractionator; recovering the heavy fraction as a bottoms from the fractionator; recycling at least a portion of the heavy fraction to the fixed bed single pass reaction zone, wherein a ratio of recycled heavy fraction to the cracked naphtha fed to the fixed bed single pass reaction zone is in the range from about 0.25:1 to about 10:1.

In another aspect, embodiments disclosed herein relate to a process for the hydrodesulfurization of a cracked naphtha stream, the process including: feeding (1) a light cracked naphtha containing olefins, diolefins, mercaptans and other organic sulfur compounds and (2) hydrogen to a first catalytic distillation reactor system; concurrently in the first catalytic distillation reactor system, (i) contacting the diolefins and the mercaptans in the light cracked naphtha in the presence of a Group VIII metal catalyst in the rectification section of the first catalytic distillation reactor system thereby reacting: (A) a portion of the mercaptans with a portion of the diolefins to form thioethers, (B) a portion of the mercaptans with a portion of the hydrogen to form hydrogen sulfide; or (C) a portion of the dienes with a portion of the hydrogen to form olefins; or (D) a combination of one or more of (A), (B), and (C); and (ii) fractionating the light cracked naphtha into a distillate product containing C5 hydrocarbons and a first heavy naphtha containing sulfur compounds; recovering the first heavy naphtha from the first catalytic distillation reactor system as a first bottoms; feeding the first bottoms, at least one of an intermediate cracked naphtha and a heavy cracked naphtha, and hydrogen to a second catalytic distillation reactor system having one or more reaction zones containing a hydrodesulfurization catalyst; concurrently in the second catalytic distillation reactor system, (i) reacting at least a portion of the mercaptans and other organic sulfur compounds in the fed first bottoms, intermediate cracked naphtha, and heavy cracked naphtha with hydrogen in the presence of the hydrodesulfurization catalyst to convert a portion of the mercaptans and other organic sulfur compounds to hydrogen sulfide, and (ii) separating the fed first bottoms, intermediate cracked naphtha, and heavy cracked naphtha into a light naphtha fraction and a heavy naphtha fraction; recovering the light naphtha fraction, unreacted hydrogen, and hydrogen sulfide from the second catalytic distillation reactor system as an overheads vapor fraction; separating the light naphtha fraction from the $H_2S$ and unreacted hydrogen; recovering the heavy naphtha fraction from the second catalytic distillation reactor system as a bottoms fraction; feeding the heavy naphtha fraction and the light naphtha fraction to a first separation zone to remove $H_2S$ therefrom and to recover a stripped combined fraction; feeding at least a portion of the stripped combined fraction to a fixed bed single pass reaction zone having an inlet and an outlet and containing a hydrodesulfurization catalyst, wherein a portion of the remaining organic sulfur compounds in the stripped combined fraction are reacted with hydrogen to produce $H_2S$; recovering an effluent from the fixed bed single pass reaction zone via the outlet and feeding the effluent to a second separation zone to remove $H_2S$ therefrom and to recover a stripped effluent; and feeding the stripped effluent to a fractionator to separate the stripped effluent into a light fraction and a heavy fraction having an ASTM D-86 initial boiling point within 30° F. of a temperature at which an analysis of the stripped effluent indicates a maximum rate of decline on a bromine number—temperature plot; recovering the light fraction as an overheads from the fractionator; recovering the heavy fraction as a bottoms from the fractionator; recycling at least a portion of the heavy fraction to the fixed bed single pass reaction zone, wherein a ratio of recycled heavy fraction to the cracked naphtha fed to the fixed bed single pass reaction zone is in the range from about 0.25:1 to about 10:1.

Other aspects and advantages of embodiments disclosed herein will be apparent from the following description and the appended claims.

DETAILED DESCRIPTION

Figure 1:
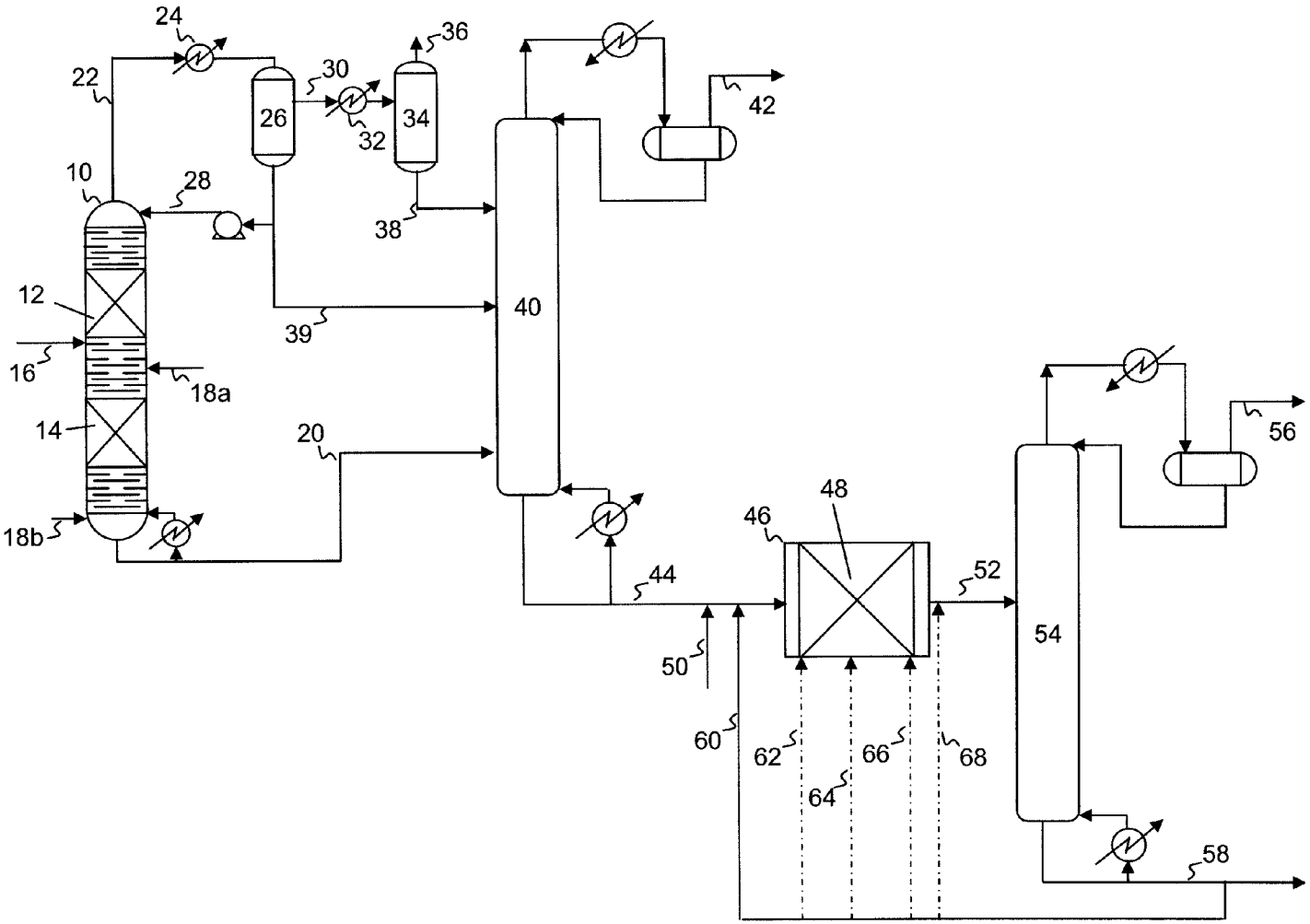
FIG. 1 is a simplified flow diagram of hydrodesulfurization processes in accordance with embodiments disclosed herein.

"Recombinant mercaptans," as used herein, refers to mercaptans that are not in the feed to the present process but are the reaction products of the $H_2S$ generated by the hydrogenation of sulfur-containing compounds in the present process and alkenes in the feed. Thus, the recombinant mercaptans are not necessarily the same as those destroyed by the hydrodesulfurization of a first portion of the present process, although they may be. The present catalytic distillation hydrodesulfurization process is considered to dissociate substantially all of the mercaptans in the feed and the small amounts of mercaptans observed in the product streams are typically recombinant mercaptans.

Within the scope of this application, the expression "catalytic distillation reactor system" denotes an apparatus in which the catalytic reaction and the separation of the products take place at least partially simultaneously. The apparatus may comprise a conventional catalytic distillation column reactor, where the reaction and distillation are concurrently taking place at boiling point conditions, or a distillation column combined with at least one side reactor, where the side reactor may be operated as a vapor phase reactor, a liquid phase reactor or a boiling point reactor, with concurrent or countercurrent vapor/liquid traffic. While both catalytic distillation reactor systems described may be preferred over conventional liquid phase reaction followed by separations, a catalytic distillation column reactor may have the advantages of decreased piece count, reduced capital cost, efficient heat removal (heat of reaction may be absorbed into the heat of vaporization of the mixture), and a potential for shifting equilibrium. Divided wall distillation columns, where at least one section of the divided wall column contains a catalytic distillation structure, may also be used, and are considered "catalytic distillation reactor systems" herein.

In one aspect, embodiments disclosed herein relate to a process for the reduction of sulfur content in gasoline range hydrocarbons. More particularly, embodiments disclosed herein relate to hydrodesulfurization processes including one or more catalytic distillation reactor systems to reduce the concentration of hydrogen sulfide in a cracked naphtha, followed by contact of at least a portion of the cracked naphtha product from the catalytic distillation reactor systems in a fixed bed reactor. The fixed bed reactor may be used to react hydrogen with additional sulfur compounds and recombinant mercaptans formed in the catalytic distillation reactor systems and associated overheads/bottoms.

It has been surprisingly found that formation of recombinant mercaptans may be reduced or eliminated by diluting the reactor feed, the contents in the reactor, and/or the reactor effluent. More particularly, it has been found that mercaptan formation occurs primarily at the reactor outlet and in downstream piping prior to separation of hydrogen sulfide from the reactor effluent. By diluting the reactor feed and/or effluent, the concentration of hydrogen sulfide in the reactor effluent downstream of the hydrodesulfurization catalyst is reduced, resulting in a decrease in recombinant mercaptan formation.

Kinetics of the reaction would indicate that a reduction in recombinant mercaptan formation would be expected, based on the reduce concentration in the effluent. For example, at a 1:1 dilution ration (recycle to feed), it may be expected that the rate of formation of recombinant mercaptans may be halved. However, it has been surprisingly found that recycle of liquid effluent from the fixed bed reactor, following removal of entrained hydrogen sulfide, may reduce the formation of recombinant mercaptans by greater than the expected amount, and even at a recycle ratio of 1:1 may essentially eliminate formation of recombinant mercaptans altogether.

The hydrocarbon feed to the processes disclosed herein may be a sulfur-containing petroleum fraction which boils in the gasoline boiling range, including FCC gasoline, coker pentane/hexane, coker naphtha, FCC naphtha, straight run gasoline, pyrolysis gasoline, and mixtures containing two or more of these streams. Such gasoline blending streams typically have a normal boiling point within the range of 0° C. and 260° C., as determined by an ASTM D86 distillation. Feeds of this type include light naphthas typically having a boiling range of about $C_5$ to 165° C. (330° F.); full range naphthas, typically having a boiling range of about $C_5$ to 215° C. (420° F.), heavier naphtha fractions boiling in the range of about 125° C. to 210° C. (260° F. to 412° F.), or heavy gasoline fractions boiling in the range of about 165° C. to 260° C. (330° F. to 500° F.). In general, a gasoline fuel will distill over the range of from about room temperature to 260° C. (500° F.).

Organic sulfur compounds present in these gasoline fractions occur principally as mercaptans, aromatic heterocyclic compounds, and sulfides. Relative amounts of each depend on a number of factors, many of which are refinery, process and feed specific. In general, heavier fractions contain a larger amount of sulfur compounds, and a larger fraction of these sulfur compounds are in the form of aromatic heterocyclic compounds. In addition, certain streams commonly blended for gasoline, such as FCC feedstocks, contain high amounts of the heterocyclic compounds. Gasoline streams containing significant amounts of these heterocyclic compounds are often difficult to process using many of the prior art methods. Very severe operating conditions have been conventionally specified for hydrotreating processes to desulfurize gasoline streams, resulting in a large octane penalty. Adsorption processes, used as an alternative to hydrogen processing, have very low removal efficiencies, since the aromatic heterocyclic sulfur compounds have adsorptive properties similar to the aromatic compounds in the hydrocarbon matrix.

Aromatic heterocyclic compounds that may be removed by the processes disclosed herein include alkyl substituted thiophene, thiophenol, alkylthiophene and benzothiophene. Among the aromatic heterocyclic compounds of particular interest are thiophene, 2-methylthiophene, 3-methylthiophene, 2-ethylthiophene, benzothiophene and dimethylbenzothiophene. These aromatic heterocyclic compounds are collectively termed "thiophenes." Mercaptans that may be removed by the processes described herein often contain from 2-10 carbon atoms, and are illustrated by materials such as 1-ethanthiol, 2-propanethiol, 2-butanethiol, 2-methyl-2-propanethiol, pentanethiol, hexanethiol, heptanethiol, octanethiol, nonanethiol, and thiophenol.

Sulfur in gasoline originating from these gasoline streams may be in one of several molecular forms, including thiophenes, mercaptans and sulfides. For a given gasoline stream, the sulfur compounds tend to be concentrated in the higher boiling portions of the stream. Such a stream may be fractionated, and a selected fraction treated using the processes described herein. Alternatively, the entire stream may be treated using the processes described herein. For example, light gasoline streams that are particularly rich in sulfur compounds, such as coker pentane/hexane, may be suitably treated as a blend stream which also contains a higher boiling, lower sulfur containing component.

In general, gasoline streams suited for treatment using the processes disclosed herein contain greater than about 10 ppm thiophenic compounds. Typically, streams containing more than 40 ppm thiophenic compounds, up to 2000 ppm thiophenic compounds and higher may be treated using the processes as described herein. The total sulfur content of the gasoline stream to be treated using the processes disclosed herein will generally exceed 50 ppm by weight, and typically range from about 150 ppm to as much as several thousand ppm sulfur. For fractions containing at least 5 volume percent boiling over about 380° F. (over about 193° C.), the sulfur content may exceed about 1000 ppm by weight, and may be as high as 4000 to 7000 ppm by weight or even higher.

In addition to the sulfur compounds, naphtha feeds, including FCC naphtha, may include paraffins, naphthenes, and aromatics, as well as open-chain and cyclic olefins, dienes, and cyclic hydrocarbons with olefinic side chains. A cracked naphtha feed useful in the processes described herein may have an overall olefins concentration ranging from about 5 to 60 weight percent in some embodiments; from about 25 to 50 weight percent in other embodiments.

In general, systems described herein may treat a naphtha or gasoline fraction in one or more catalytic distillation reactor systems. Each catalytic distillation reactor system may have one or more reaction zones including a hydrodesulfurization catalyst. For example, reactive distillation zones may be contained within the stripping section, hydrodesulfurizing the heavier compounds, or within the rectification section, hydrodesulfurizing the lighter compounds, or both. Hydrogen may also be fed to the catalytic distillation reactor system, such as below the lowermost catalytic reaction zone, and in some embodiments, a portion of the hydrogen may be fed at multiple locations, including below each reaction zone.

In each catalytic distillation reactor system, the steps to catalytically react the naphtha feed with hydrogen may be carried out at a temperature in the range of 400° F. to 800° F. at 50 to 400 psig pressure with hydrogen partial pressure in the range of 0.1 to 100 psi at 20 to 1200 scf/bbl at weight hourly space velocities (WHSV) in the range of 0.1 to 10 $hr^{-1}$ based on feed rate and a particulate catalyst packaged in structures. If advanced specialty catalytic structures are used (where catalyst is one with the structure rather than a form of packaged pellets to be held in place by structure), the liquid hourly space velocity (LHSV) for such systems should be about in the same range as those of particulate or granular-based catalytic distillation catalyst systems as just referenced. As can be seen, the conditions suitable for the desulfurization of naphtha in a distillation column reactor system are very different from those in a standard trickle bed reactor, especially with regard to total pressure and hydrogen partial pressure. In other embodiments, conditions in a reaction distillation zone of a naphtha hydrodesulfurization distillation column reactor system are: temperatures in the range from 450° F. to 700° F., total pressure in the range from 75 to 300 psig, hydrogen partial pressure in the range from 6 to 75 psia, WHSV of naphtha in the range from about 1 to 5, and hydrogen feed rates in the range from 10 to 1000 scf/bbl.

The operation of a distillation column reactor results in both a liquid and a vapor phase within the distillation reaction zone. A considerable portion of the vapor is hydrogen, while a portion of the vapor is hydrocarbons from the hydrocarbon feed. In catalytic distillation it has been proposed that the mechanism that produces the effectiveness of the process is the condensation of a portion of the vapors in the reaction system, which occludes sufficient hydrogen in the condensed liquid to obtain the requisite intimate contact between the hydrogen and the sulfur compounds in the presence of the catalyst to result in their hydrogenation. In particular, sulfur species concentrate in the liquid while the olefins and $H_2S$ concentrate in the vapor, allowing for high conversion of the sulfur compounds with low conversion of the olefin species. The result of the operation of the process in the catalytic distillation reactor system is that lower hydrogen partial pressures (and thus lower total pressures) may be used, as compared to typical fixed bed hydrodesulfurization processes.

As in any distillation, there is a temperature gradient within the catalytic distillation reactor system. The lower end of the column contains higher boiling material and thus is at a higher temperature than the upper end of the column. The lower boiling fraction, which contains more easily removable sulfur compounds, is subjected to lower temperatures at the top of the column, which may provide for greater selectivity, that is, no hydrocracking or less saturation of desirable olefinic compounds. The higher boiling portion is subjected to higher temperatures in the lower end of the distillation column reactor to crack open the sulfur containing ring compounds and hydrogenate the sulfur. The heat of reaction simply creates more boil up, but no increase in temperature at a given pressure. As a result, a great deal of control over the rate of reaction and distribution of products can be achieved by regulating the system pressure.

A simplified flow diagram of a process for the hydrodesulfurization of cracked naphthas according to embodiments disclosed herein is illustrated in FIG. 1. In this embodiment, a catalytic distillation reactor system 10 is illustrated, which includes two reaction zones 12, 14 in the rectification section and the stripping section of the column, respectively. Naphtha and hydrogen may be introduced via flow lines 16 and 18*a*, 18*b*, respectively, to catalytic distillation reactor system 10. Heavy hydrocarbons contained in the naphtha traverse downward through the column, contacting a hydrodesulfurization catalyst contained in reaction zone 14 in the presence of hydrogen to hydrodesulfurize at least a portion of the organic sulfur compounds to form hydrogen sulfide. Similarly, light hydrocarbons contained in the naphtha traverse upward through the column, contacting a hydrodesulfurization catalyst contained in the rectification zone 12 in the presence of hydrogen to hydrodesulfurize at least a portion of the organic sulfur compounds to form hydrogen sulfide. A hydrodesulfurized heavy naphtha fraction may be withdrawn as a bottoms fraction from catalytic distillation reactor system 10 via flow line 20.

An overhead vapor fraction, including various hydrocarbons, unreacted hydrogen, and hydrogen sulfide, may be withdrawn from catalytic distillation column reactor 10 via flow line 22. The overhead vapor fraction may be partially condensed and separated from uncondensed vapors via cooler 24 and hot drum 26. A portion of the condensed hydrocarbons may be returned to catalytic distillation reactor system 10 as reflux via flow line 28. The uncondensed vapors recovered via flow line 30 may be further cooled, condensed, and separated, via heat exchanger 32 and cold drum 34. Hydrogen and hydrogen sulfide may be recovered from cold drum 34 via flow line 36, and a light naphtha fraction may be recovered via flow line 38.

As illustrated in FIG. 1, the heavy naphtha fraction recovered via flow line 20, condensate recovered from hot drum 26 via flow line 39 (the portion not used as reflux), and hydrocarbons recovered via flow line 38 from cold drum 34 are fed to stripper 40, to separate any dissolved or entrained hydrogen and hydrogen sulfide from the heavy and light naphtha fractions recovered via flow lines 20, 38, and 39, where the hydrogen and hydrogen sulfide may be recovered via flow line 42 and the combined naphtha fractions may be recovered via flow line 44.

Hydrogen sulfide vapors produced in reaction zone 14 typically traverse upward through catalytic distillation reactor system 10 and are available to form recombinant mercaptans in reaction zone 12. Hydrogen sulfide vapors produced in both reaction zone 12 and 14 typically continue to traverse upward through the catalytic distillation reactor system 10 and are available to form recombinant mercaptans in the overhead system components, including flow lines 22, 30, heat exchangers 24, 32, hot drum 26, and cold drum 34.

The combined naphtha fraction recovered from stripper 40 via flow line 44 contains unreacted sulfur compounds present in the feed as well as recombinant mercaptans formed as discussed above. The combined naphtha fraction, or a portion thereof, may then be fed to a fixed bed single pass reactor 46 having a reaction zone 48 containing hydrodesulfurization catalyst. Hydrogen may also be fed to the reactor via flow line 50, and additionally or alternatively may be fed at multiple locations (not shown) along the length of reaction zone 48. In the reaction zone, hydrogen and sulfur-containing compounds may react over the hydrodesulfurization catalyst to form hydrogen sulfide. Effluent from the reactor 46 may then be recovered via flow line 52, where the effluent may contain unreacted hydrogen, hydrogen sulfide, and the combined naphtha fraction having a reduced concentration of sulfur-containing compounds.

The effluent from the fixed bed reactor 46 may then be fed to a separation zone, such as a second stripper 54, to separate the unreacted hydrogen and hydrogen sulfide from the naphtha fraction. Alternatively, the separation system including a hot drum, cold drum, and stripper as shown and described with respect to FIG. 4 may be used. The hydrogen and hydrogen sulfide may be recovered via flow line 56 and the naphtha in the reactor effluent may be recovered via flow line 58 as a bottoms fraction from the stripper. Preferably, stripper 54 is operated such that the concentration of hydrogen sulfide in the bottoms fraction is less than 1 ppm by weight, less than 0.5 ppm by weight, less than 0.1 ppm by weight, or less than 0.05 ppm, by weight, in various embodiments.

To reduce or eliminate the formation of recombinant mercaptans following hydrodesulfurization in reaction zone 48, the reactor contents may be diluted using a portion of the stripped naphtha fraction recovered from stripper 54 via flow line 58. For example, a portion of the stripped naphtha fraction may be recycled via flow line 60 to the fixed bed reaction zone 48.

In some embodiments, the ratio of recycled stripped naphtha fed via flow line 60 to the combined naphtha fraction fed via flow line 50 may be in the range from about 0.1:1 to about 20:1. In other embodiments, the ratio of recycle to feed may range from a lower limit of 0.1:1, 0.2:1, 0.25:1, 0.3:1, 0.4:1, 0.5:1, 0.6:1, 0.7:1, 0.8:1, 0.9:1, or 1:1 to an upper limit of 1:1, 1.25:1, 1.5:1, 1.75:1, 2:1, 3:1, 4:1, 5:1, or 10:1, where any lower limit may be combined with any upper limit.

As mentioned above, it has been found that recombinant mercaptans may primarily be formed downstream of reaction zone 48. Accordingly, dilution of the hydrogen sulfide may be achieved by addition of recycle to the reactor inlet, at one or more points along the length of reaction zone 48, and/or combined with the reactor effluent as close to the reactor as possible. These alternatives are illustrated via flow lines 62, 64, 66, and 68. The effect of recycle location may have a minor impact on the total reduction in recombinant mercaptan formation. However, the benefit in addition of recycle downstream of the reaction zone may be in potentially reducing the reactor size, and reducing the number of passes for olefinic compounds, potentially reducing hydrogenation of the olefinic compounds. The location of the recycle may thus depend on the desired reduction in recombinant mercaptans, reactor size/cost, and olefin losses that may be tolerated for the specific process, among other factors recognizable to one skilled in the art.

As mentioned above, a portion or the entire combined naphtha fraction recovered from stripper 40 via flow line 44 may fed to the fixed bed reactor 46. The target concentration of sulfur in the hydrodesulfurized product recovered via flow line 58 may depend upon the sulfur content of the various refinery products to be blended to form a gasoline, regulations in effect, and other factors. Bypassing of reactor 46 may thus be a means to control costs (catalyst cycle time, severity of conditions, etc.) and may be used to control the total sulfur content of the end product.

Figure 2:
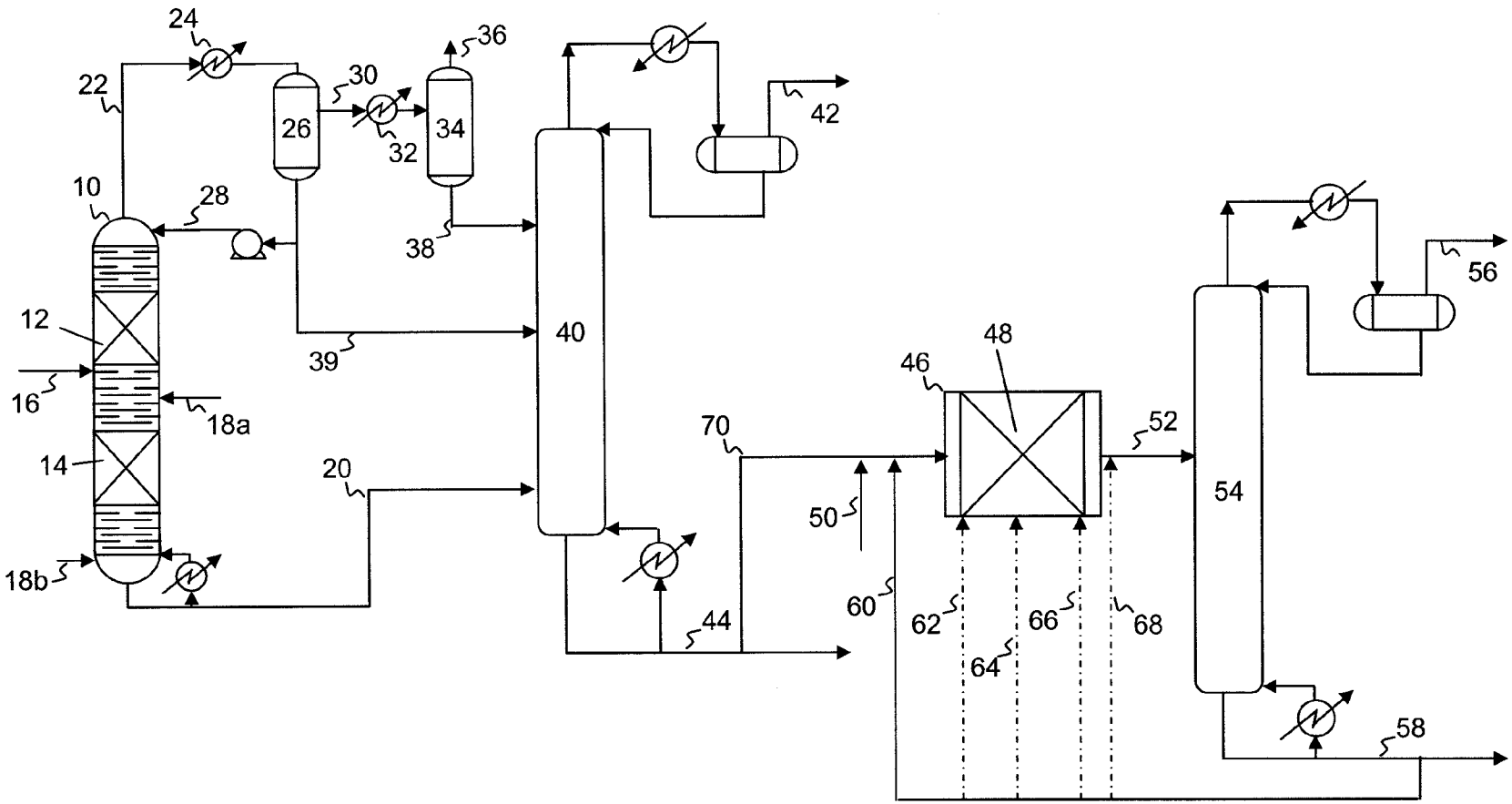
FIG. 2 is a simplified flow diagram of hydrodesulfurization processes in accordance with embodiments disclosed herein.

Referring now to FIG. 2, a simplified flow diagram of a process for hydrodesulfurizing a hydrocarbon feed according to embodiments disclosed herein is illustrated, where like numerals represent like parts. In this embodiment, only a portion of the combined naphtha fraction recovered from stripper 40 via flow line 44 is fed to the fixed bed reactor 46, such as via flow line 70. The portion bypassing reactor 46 and the stripped reactor effluent recovered via flow line 58 (the portion not recycled) may be combined (not illustrated) to form a hydrodesulfurized product, or may be fed separately to downstream processes or used for gasoline blending.

Figure 3:
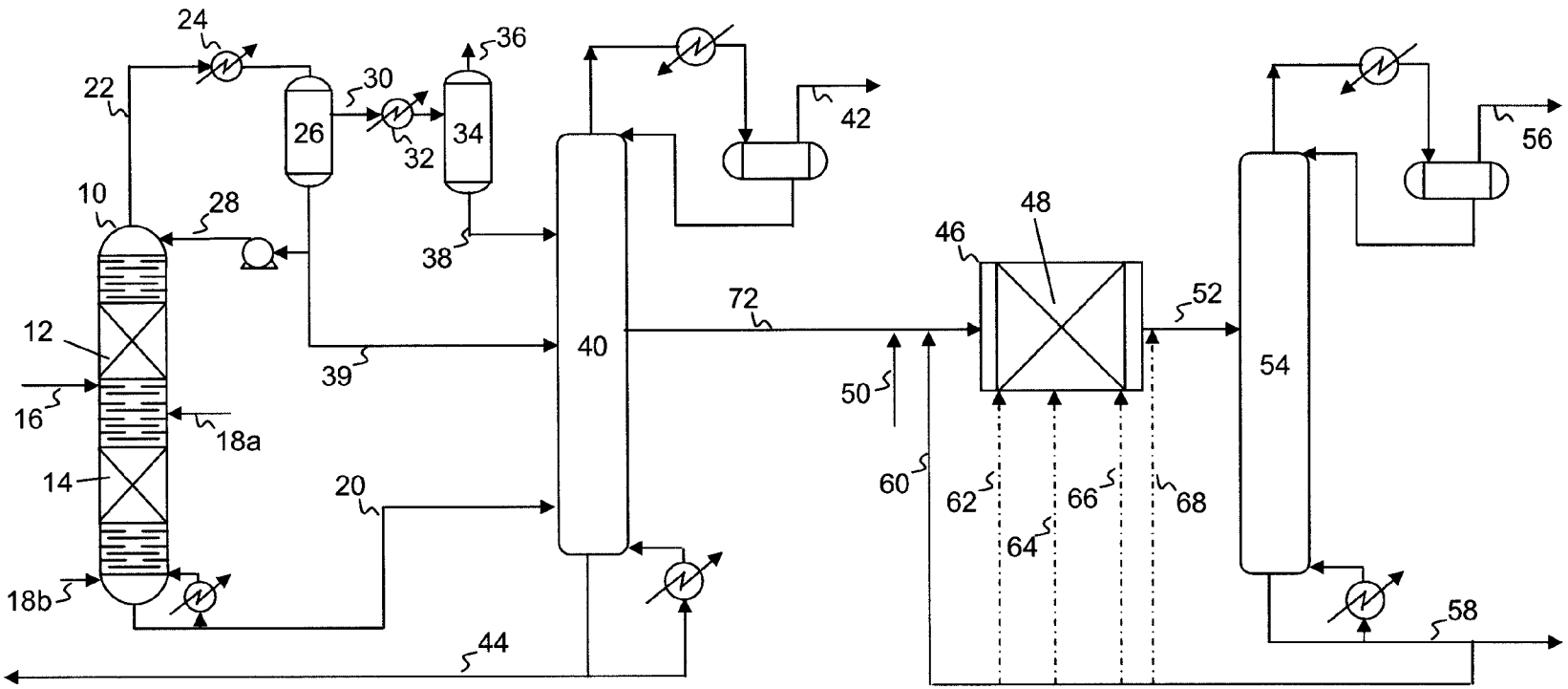
FIG. 3 is a simplified flow diagram of hydrodesulfurization processes in accordance with embodiments disclosed herein.

Referring now to FIG. 3, a simplified flow diagram of a process for hydrodesulfurizing a hydrocarbon feed according to embodiments disclosed herein is illustrated, where like numerals represent like parts. In this embodiment, only a portion of the combined naphtha fraction, recovered as a side draw from the stripper via flow line 72, is fed to the fixed bed reactor 46. The stripper bottoms recovered via flow line 44 and the stripped effluent recovered via flow line 58 may be combined or used separately, as noted above with respect to FIG. 2.

Figure 4:
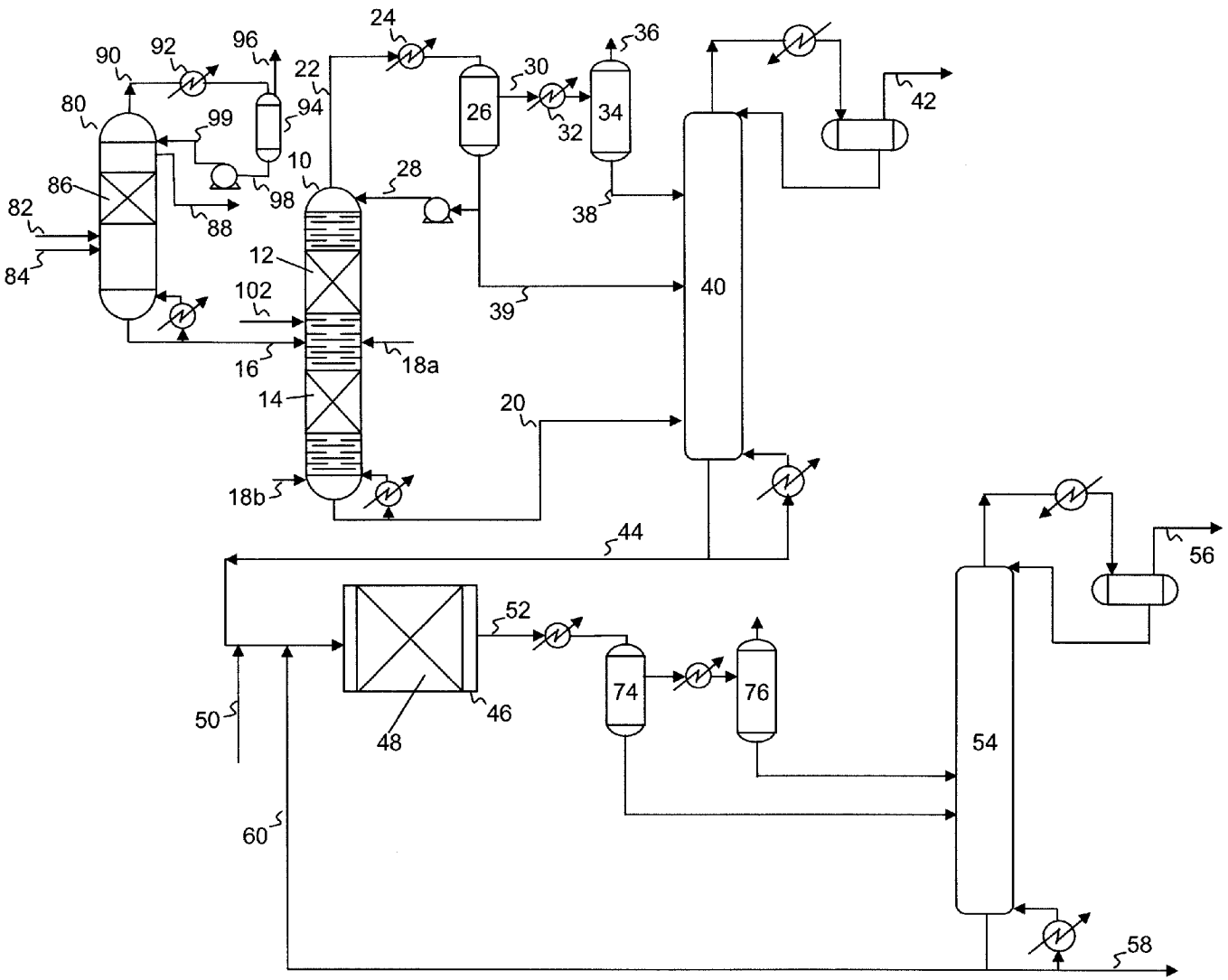
FIG. 4 is a simplified flow diagram of hydrodesulfurization processes in accordance with embodiments disclosed herein.

Referring now to FIG. 4, a simplified flow diagram of a process for hydrodesulfurizing a hydrocarbon feed according to embodiments disclosed herein is illustrated, where like numerals represent like parts. In this embodiment, separation of hydrogen sulfide from the fixed bed reactor effluent is achieved using a hot drum 74 and cold drum 76 intermediate the reactor outlet and stripper 54, similar to the overhead system associated with the catalytic distillation reactor system 10. The cooling and flashing of the reactor effluent may result in a rapid decrease in the concentration of hydrogen sulfide, limiting the formation of recombinant mercaptans between the reactor 46 and stripper 54. The liquid effluents from the hot and cold drums may then be fed to stripper 54 and processed as described above.

Also shown in FIG. 4 is a second catalytic distillation reactor system 80, which may be used separately or cumulative to the added reactor effluent separation in various flow schemes shown herein. Prior to hydrodesulfurization as described above with respect to FIGS. 1-3, hydrogen and the cracked naphtha, such as a full range cracked naphtha, may initially be fed via flow lines 82 and 84, respectively, to a first catalytic distillation reactor system 80 having one or more reactive distillation zones 86 for hydrotreating the hydrocarbon feed. As illustrated, catalytic distillation reactor system 80 includes at least one reactive distillation zone 86, located in an upper portion of the column, above the feed inlet, for treating the light hydrocarbon components in the feed.

Reaction zone 86 may include one or more catalysts for the hydrogenation of dienes, reaction of mercaptans and dienes (thioetherification), hydroisomerization, and hydrodesulfurization. For example, conditions in the first catalytic distillation reactor system 80 may provide for thioetherification and/or hydrogenation of dienes and removal of mercaptan sulfur from the $C_5/C_6$ portion of the hydrocarbon feed. The $C_5/C_6$ portion of the naphtha, having a reduced sulfur content as compared to the $C_5/C_6$ portion of the feed, may be recovered from catalytic distillation reactor system 80 as a side draw product 88.

An overheads fraction may be recovered from catalytic distillation reactor system 80 via flow line 90, and may contain light hydrocarbons and unreacted hydrogen. The first overheads 90 may be cooled, such as using a heat exchanger 92, and fed to an overhead condenser or collection drum 94. In overhead condenser 94, unreacted hydrogen may be separated from the hydrocarbons contained in the overhead fraction, with unreacted hydrogen withdrawn from overhead condenser 94 via flow line 96. Condensed hydrocarbons may be withdrawn from overhead condenser 98 and fed to first catalytic distillation reactor system 80 as a total or partial reflux via flow line 99.

The $C_5/C_6$ side draw product withdrawn from catalytic distillation reactor system 80 via flow line 88 may contain many of the olefins present in the hydrocarbon feed. Additionally, dienes in the $C_5/C_6$ cut may be hydrogenated during treatment in catalytic distillation reactor system 80. This hydrogenated, desulfurized $C_5/C_6$ side draw product may thus be recovered for use in various processes. In various embodiments, the $C_5/C_6$ side draw product may be used as a gasoline blending fraction, hydrogenated and used as a gasoline blending feedstock, and as a feedstock for ethers production, among other possible uses. The particular processing or end use of the $C_5/C_6$ fraction may depend upon various factors, including availability of alcohols as a raw material, and the allowable olefin concentration in gasoline for a particular jurisdiction, among others The heavy naphtha, e.g., $C_{6+}$ boiling range components, including any thioethers formed in reaction zone 86 and various other sulfur compounds contained in the hydrocarbon feed, may be recovered as a bottoms fraction from catalytic distillation reactor system 80 via flow line 16 and fed to catalytic distillation reactor system 10, as described with respect to FIGS. 1-3.

In other embodiments, the product from the catalytic cracking unit may be pre-fractionated into a light cracked naphtha fraction and a heavy cracked naphtha fraction and separately fed to the process illustrated in FIG. 4. The light cracked naphtha fraction may be fed via flow line 84 and processed in catalytic distillation reactor system 80 as described above. The $C_{6+}$ portion recovered via flow line 16 may then be fed to catalytic distillation reactor system 10 along with the heavy cracked naphtha fraction fed via flow line 102, where the combined light and heavy cracked naphtha fractions are then processed as described above.

It has also been discovered that an additional benefit may be realized by recycling only a heavier portion of the stripped reactor effluent. It has been found that the cracked naphtha processed as described above and recovered via flow line 58, when this fraction is split into two fractions, the light fraction is found to have a very low sulfur content and a high olefin concentration. The heavy fraction tends to contain more sulfur, and has a low or nil olefin concentration. Thus, recycling only the heavier portion of the stripped reactor effluent may further reduce the concentration of olefins present at the exit of the polishing reactor, thus providing even less driving force for the formation of recombinant mercaptans.

Figure 5:
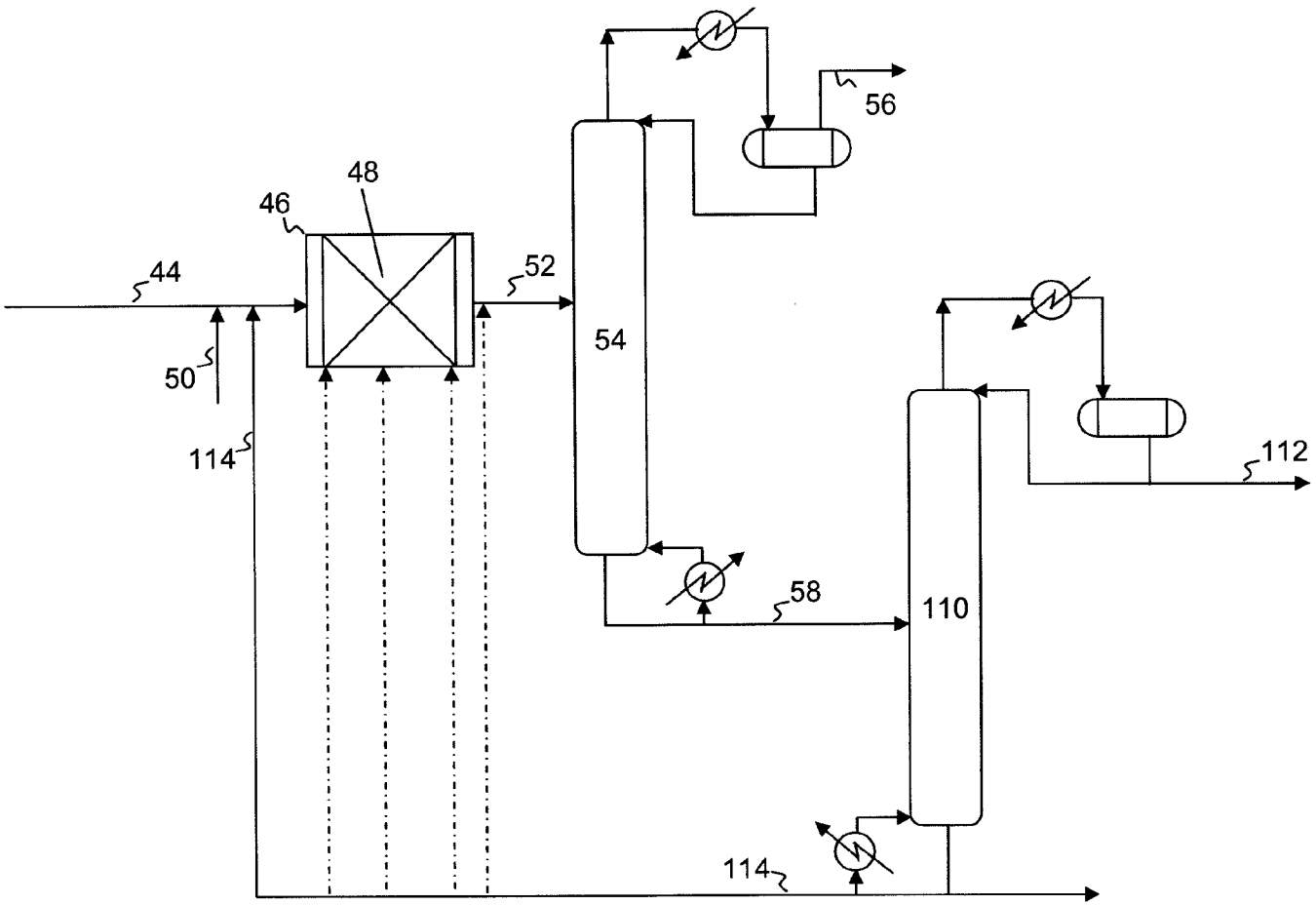
FIG. 5 is a simplified flow diagram of hydrodesulfurization processes in accordance with embodiments disclosed herein.

Referring now to FIG. 5, a simplified flow diagram of a process for hydrodesulfurizing a hydrocarbon feed according to embodiments disclosed herein is illustrated, where like numerals represent like parts. In this embodiment, the cracked naphtha is processed initially as described above for any one of FIGS. 1-4. The bottoms product from stripper 54 is then fed to fractionator 110 and separated into a light gasoline fraction, recovered as an overheads via flow line 112, and a heavy gasoline fraction, recovered via flow line 114. The heavy gasoline fraction, containing a low or nil concentration of olefins, is recycled via flow line 114 to reactor 46 for processing as described above.

To achieve the benefits of the separate fractions (light vs. heavy), it has been found that the ASTM D-86 Initial Boiling Point of the heavy fraction should be sufficiently high so as to minimize or significantly decrease the amount of olefins recycled with the heavy fraction, which may depend upon the crude source, upstream processing conditions, and other factors. In general, it has been found that the ASTM D-86 Initial Boiling Point of the heavy fraction should be greater than about 240° F. in some embodiments, and greater than 250° F., 260° F., 270° F., or 280° F. in various other embodiments. The ASTM D-86 Initial Boiling Point of the heavy fraction may be in the range from about 250° F. to about 330° F. in some embodiments; in the range from about 270° F. to about 330° F. in other embodiments; in the range from about 280° F. to about 330° F. in other embodiments; and in the range from about 290° F. to about 330° F. in yet other embodiments.

Figure 6:
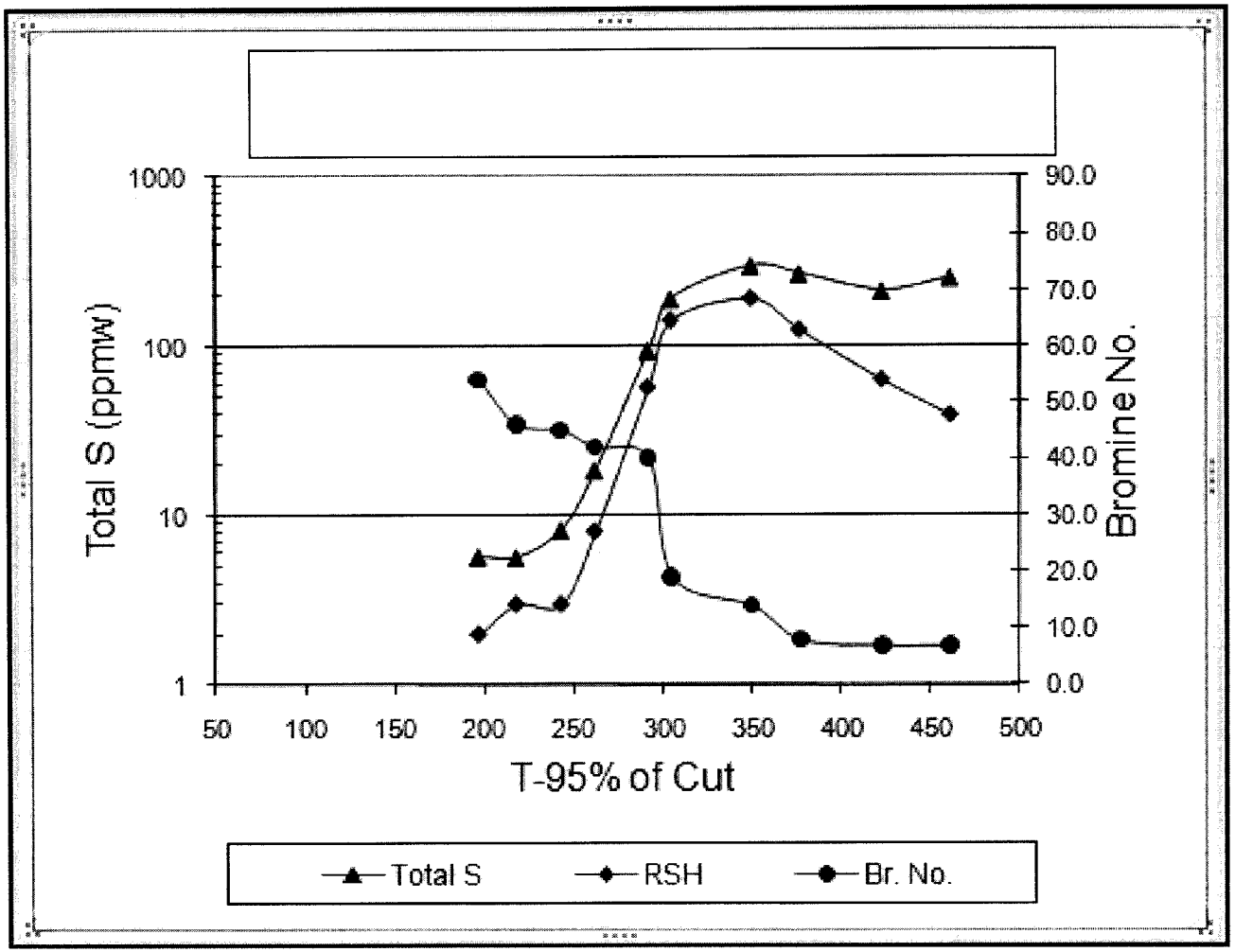
FIG. 6 is an exemplary plot illustrating the sulfur content and olefin content versus temperature for a stream used during embodiments of processes disclosed herein

For example, a bottoms product from stripper 54 may have an olefins and sulfur profile as illustrated in FIG. 6, where the mercaptan sulfur (RSH) and the total sulfur (Total S) increase significantly starting around 250° F. to about 290° F. and an olefin concentration (Bromine No.) that decreases at similar temperatures. Over this temperature range of the chart in FIG. 6, sulfur content versus temperature plot passes through a maximum in the rate of incline, and the Bromine number versus temperature plot passes through a maximum in the rate of decline. Recycling of a heavy fraction having an ASTM D-86 initial boiling point in the range from about 250° F. to about 300° F. would be suitable, so as to decrease or minimize the olefins in the recycle while recycling a significant amount of the heavier sulfur-containing species. As noted above, the sulfur and olefin inflection points may vary depending upon the crude source as well as upstream processing conditions, among other factors. Accordingly, in some embodiments disclosed herein, the recycled heavy fraction may have an ASTM D-86 initial boiling point within ±40° F., ±30° F., ±25° F., ±20° F., or ±10° F. of the temperature at which the Bromine number vs. temperature curve (linear plot) for the bottoms product from stripper 54 has a maximum rate of decline. In other embodiments disclosed herein, recycle of a heavy fraction having an ASTM D-86 initial boiling point within ±40° F., ±30° F., ±25° F., ±20° F., or ±10° F. of the temperature at which the total sulfur vs. temperature curve (log scale for sulfur content) for the bottoms product from stripper 54 has a maximum rate of incline.

The fixed bed reactor, in some embodiments, is operated as a three phase reactor—two phase flow plus a solid catalyst. Recycling of only the heavier gasoline fraction offers the following advantages: the low sulfur recycle dilutes the concentration of sulfur in the feed to the reactor; the recycle material has very low olefin concentration, thus dilutes the concentration of olefins in the feed and/or outlet of the reactor; the heavier material allows for a lower operating pressure while maintaining 2-phase flow, thus resulting in improved selectivity; and the lower sulfur concentration and lower olefin concentration reduces the amount of recombinant mercaptans in the product. The lower operating pressure allowed may further reduce the partial pressure of the hydrogen sulfide and olefins in the reactor.

In a catalytic distillation reactor system, such as catalytic distillation reactor 80, the naphtha feed may be concurrently fractionated and hydrogenated. The conditions in a reaction zone of a first catalytic distillation reactor system are: temperatures in the range from 200° F. to 400° F., total pressure in the range from 50 to 300 psig, hydrogen partial pressure in the range from 0.1 to 75 psia, WHSV of naphtha in the range from about 1 to 10, and hydrogen feed rates in the range from 10 to 1000 scf/bbl. The conditions in the first catalytic distillation reactor system allow for hydrogenation of dienes and removal of mercaptan sulfur via thioetherification (reaction of mercaptan with a diene).

Conditions in a reaction zone of a second catalytic distillation reactor system, such as a catalytic distillation reactor 10, are: temperatures in the range from 300° F. to 800° F., total pressure in the range from 75 to 350 psig, hydrogen partial pressure in the range from 6 to 100 psia, WHSV of naphtha in the range from about 1 to 5, and hydrogen feed rates in the range from 10 to 1000 scf/bbl. The conditions in the second catalytic distillation reactor system allow for selective desulfurization of alcohols to a concentration of between about 20 to about 120 ppm sulfur, by weight.

As described above, processes disclosed herein may additionally treat a naphtha or gasoline fraction, or a select portion thereof, in one or more fixed bed reactor systems. Each fixed bed reactor system may include one or more reactors in series or parallel, each reactor having one or more reaction zones containing one or more hydrodesulfurization catalysts. Such fixed bed reactors may be operated as a vapor phase reactor, a liquid phase reactor, or a mixed phase (V/L) reactor and may include traditional fixed bed reactors, trickle bed reactors, pulse flow reactors, and other reactor types known to those skilled in the art. The operating conditions used in the fixed bed reactor systems may depend upon the reaction phase(s), the boiling range of the naphtha fraction being treated, catalyst activity, selectivity, and age, and the desired sulfur removal per reaction stage, and the target sulfur compounds, among other factors.

Catalysts in the first catalytic distillation reactor column may be characterized as thioetherification catalysts or alternatively hydrogenation catalysts. In the first catalytic distillation reactor column, reaction of the diolefins with the sulfur compounds is selective over the reaction of hydrogen with olefinic bonds. The preferred catalysts are palladium and/or nickel or dual bed as shown in U.S. Pat. No. 5,595,643, which is incorporated herein by reference, since in the first catalytic distillation reactor column the sulfur removal is carried out with the intention to preserve the olefins. Although the metals are normally deposited as oxides, other forms may be used. The nickel is believed to be in the sulfide form during the hydrogenation.

Another suitable catalyst for the thioetherification reaction may be 0.34 wt % Pd on 7 to 14 mesh alumina spheres, supplied by Sud-Chemie, designated as G-68C. The catalyst also may be in the form of spheres having similar diameters. They may be directly loaded into standard single pass fixed bed reactors which include supports and reactant distribution structures. However, in their regular form they form too compact a mass for operation in a catalytic distillation reactor system column and must then be prepared in the form of a catalytic distillation structure. The catalytic distillation structure must be able to function as catalyst and as mass transfer medium. The catalyst must be suitably supported and spaced within the column to act as a catalytic distillation structure. Generally the mole ratio of hydrogen to diolefins and acetylenes in the feed is at least 1.0 to 1.0 and preferably 2.0 to 1.0.

In second and subsequent catalytic distillation reactor columns and catalytic reaction zones, including the fixed bed reactor, it may be the purpose of the catalyst to destroy the sulfur compounds to produce a hydrocarbon stream containing hydrogen sulfide, which is easily separated from the heavier components therein. Hydrogen and hydrogen sulfide may be separated from heavy hydrocarbon components in a stripping column, as described above. The focus of these catalytic reactions that occur after the first catalytic distillation reactor column is to carry out destructive hydrogenation of the sulfides and other organic sulfur compounds.

Catalysts useful as the hydrodesulfurization catalyst in the reaction zones of the respective catalytic distillation reactor systems may include Group VIII metals, such as cobalt, nickel, palladium, alone or in combination with other metals, such as molybdenum or tungsten, on a suitable support, which may be alumina, silica-alumina, titania-zirconia or the like. Normally the metals are provided as the oxides of the metals supported on extrudates or spheres and as such are not generally useful as distillation structures. Alternatively, catalyst may be packaged in a suitable catalytic distillation structure, which characteristically can accommodate a wide range of typically manufactured fixed bed catalyst sizes.

The catalysts may contain components from Groups V, VIB, and VIII metals of the Periodic Table or mixtures thereof. The incorporation of the distillation column reactor systems may reduce the deactivation of catalysts and may provide for longer runs than the fixed bed hydrogenation reactors of the prior art. The Group VIII metal may also provide increased overall average activity. Catalysts containing a Group VIB metal, such as molybdenum, and a Group VIII metal, such as cobalt or nickel, are preferred. Catalysts suitable for the hydrodesulfurization reaction include cobalt-molybdenum, nickel-molybdenum and nickel-tungsten. The metals are generally present as oxides supported on a neutral base such as alumina, silica-alumina or the like. The metals are reduced to the sulfide either in use or prior to use by exposure to sulfur compound containing streams and hydrogen.

The hydrodesulfurization catalysts may also catalyze the hydrogenation of the olefins and polyolefins contained within the light cracked naphtha and to a lesser degree the isomerization of some of the mono-olefins. The hydrogenation, especially of the mono-olefins in the lighter fraction, may not be desirable.

The hydrodesulfurization catalyst typically is in the form of extrudates having a diameter of 1/8, 1/16 or 1/32 inches and an L/D of 1.5 to 10. The catalyst also may be in the form of spheres having similar diameters. They may be directly loaded into standard single pass fixed bed reactors which include supports and reactant distribution structures. However, in their regular form they form too compact a mass for operation in the catalytic distillation reactor system column and must then be prepared in the form of a catalytic distillation structure. As described above, the catalytic distillation structure must be able to function as catalyst and as mass transfer medium. The catalyst must be suitably supported and spaced within the column to act as a catalytic distillation structure.

In some embodiments, the catalysts are contained in a structure as disclosed in U.S. Pat. No. 5,730,843, which is hereby incorporated by reference. In other embodiments, catalyst is contained in a plurality of wire mesh tubes closed at either end and laid across a sheet of wire mesh fabric such as demister wire. The sheet and tubes are then rolled into a bale for loading into the distillation column reactor. This embodiment is described, for example, in U.S. Pat. No. 5,431,890, which is hereby incorporated by reference. Other useful catalytic distillation structures are disclosed in U.S. Pat. Nos. 4,731,229, 5,073,236, 5,431,890 and 5,266,546, which are each incorporated by reference.

Hydrodesulfurization catalysts described above with relation to the operation of the catalytic distillation reactor systems may also be used in the fixed bed catalytic reactors. In selected embodiments, catalysts used in the fixed bed catalytic reactors may include hydrodesulfurization catalysts that only promote the desulfurization of mercaptan species, which are among the easiest to convert to hydrogen sulfide. Conditions in the fixed bed catalytic reactors may include high temperatures and high hydrogen mole fractions, which are conducive to olefin saturation. For preservation of olefin content and conversion of mercaptans to hydrogen sulfide at these conditions, suitable catalysts may include nickel catalysts with very low molybdenum promotion, or no promoters at all, and molybdenum catalysts with very low copper promotion, or no promoters at all. Such catalysts may have lower hydrogenation activity, promoting the desulfurization of the mercaptan species without significant loss of olefins.

In some embodiments, the catalytic distillation reactor systems described above may contain one or more hydrodesulfurization reaction zones. For such systems containing only one reaction zone, the reaction zone should be located in the rectification portion of the column, contacting the light portion of the feed with the hydrodesulfurization catalyst. Hydrodesulfurization of the heavy fraction may occur in the catalytic distillation reactor systems, such as where a reaction zone is additionally located in the stripping portion of the column. Optionally, the heavy portion may be hydrodesulfurized in a stand alone reactor, such as a fixed bed reactor containing a hydrodesulfurization catalyst.

After treatment according to the processes described herein, the total sulfur content of the hydrodesulfurized naphtha fractions (i.e., flow line 58) may be less than about 50 ppm in some embodiments; less than 40 ppm in other embodiments; less than 30 ppm in other embodiments; less than 20 ppm in other embodiments; less than 10 ppm in other embodiments; less than 5 ppm in other embodiments; and less than 1 ppm in yet other embodiments, where each of the above are based on weight. Due to the dilution of the fixed bed reactor effluent, the mercaptan sulfur content of the hydrodesulfurized naphtha fractions may be less than 20 pm in some embodiments; less than 15 ppm in other embodiments; less than 10 ppm in other embodiments; less than 5 ppm in other embodiments; less than 2 ppm in other embodiments; less than 1 ppm in other embodiments, and undetectable via method D-3227 in yet other embodiments.

In contrast to typical hydrodesulfurization processes, which often use extremely harsh operating conditions to reduce sulfur content, resulting in significant loss of olefins, desulfurized products resulting from the processes disclosed herein may retain a significant portion of the olefins, resulting in a higher value end product. In some embodiments, products resulting from the processes described herein may have an overall olefins concentration ranging from 5 to 55 weight percent; from about 10 to about 50 weight percent in other embodiments; and from about 20 to about 45 weight percent in other embodiments. As compared to the initial hydrocarbon feed (such as flow line 16) the overall product streams recovered from embodiments disclosed herein (such as flow lines 44 and/or 58) may retain at least 25% of the olefins in the initial hydrocarbon feed; at least 30% of the olefins in the initial hydrocarbon feed in other embodiments; at least 35% of the olefins in the initial hydrocarbon feed in other embodiments; at least 40% of the olefins in the initial hydrocarbon feed in other embodiments; at least 45% of the olefins in the initial hydrocarbon feed in other embodiments; at least 50% of the olefins in the initial hydrocarbon feed in other embodiments; at least 60% of the olefins in the initial hydrocarbon feed in other embodiments; and at least 70% of the olefins in the initial hydrocarbon feed in other embodiments.

EXAMPLES

Example 1

A cracked naphtha having the following characteristics was first treated in a catalytic distillation column containing a commercial hydrodesulfurization catalyst. The hydrocarbon feed contained 2656 mg/liter of total sulfur and had a bromine number of 27.48. The hydrocarbon feed was fed between the two catalyst beds and had the following distillation properties (measured via ASTM D-86):

| | |
|---|---|
| Initial boiling point | 200° F. |
| 10% | 231° F. |
| 30% | 259.5° F. |
| 50% | 302° F. |
| 70% | 350.4° F. |
| 90% | 394.3° F. |
| Final boiling point | 435.8° F. |

The overheads and bottoms fractions were recovered in a manner similar to that shown in FIG. 1, combined, and separated from hydrogen sulfide in a stripper. The bottoms product from the stripper contained 84 ppm of total sulfur, 34 ppm of mercaptan sulfur (RSH), and had a bromine number of 17.

The product from the stripper was sent to a polishing (fixed bed) reactor to further reduce the sulfur content. The fixed bed reactor feed was mixed in a 1:1 ratio by weight with product from the polishing reactor which had subsequently been stripped to have a concentration of less than 0.1 ppm $H_2S$ prior to recycle. The catalyst in the polishing reactor was DC-130, available from Criterion Catalyst. The LHSV of the reactor was 10.9 $h^{-1}$. The inlet temperature of the polishing reactor was 504° F., the $H_2$ rate was set to 107 SCF/bbl, and the pressure was controlled to 205 psig.

Hydrogen sulfide was then stripped from the effluent from the polishing reactor. The final hydrodesulfurized product contained 7.2 ppm of total sulfur, with a bromine number of 11.9. Mercaptan sulfur concentration in the product was measured using ASTM D-3227, and no mercaptan sulfur was detected.

Comparative Example 2

A cracked naphtha having the following characteristics was first treated in a catalytic distillation column containing a commercial hydrodesulfurization catalyst. The hydrocarbon feed was fed between the two catalyst beds and had the following distillation properties (measured via ASTM D-3710):

| | |
|---|---|
| Initial boiling point | 98° F. |
| 10% | 173° F. |

-continued

| | |
|---|---|
| 30% | 219° F. |
| 50% | 275° F. |
| 70% | 325° F. |
| 90% | 394° F. |
| Final boiling point | 440° F. |

The overheads and bottoms fractions were recovered in a manner similar to that shown in FIG. 1, combined, and separated from hydrogen sulfide in a stripper. The bottoms product from the stripper contained 77 ppm of total sulfur, 49.4 ppm of mercaptan sulfur (RSH), and had a bromine number of 22.3.

The product from the stripper was sent to a polishing (fixed bed) reactor to further reduce the sulfur content. The fixed bed reactor feed was not diluted. The catalyst in the polishing reactor was DC-130, available from Criterion Catalyst. The LHSV of the reactor was 9.1 $h^{-1}$. The inlet temperature of the polishing reactor was 502° F., the $H_2$ rate was set to 138 SCF/bbl, and the pressure was controlled to 215 psig.

Hydrogen sulfide was then stripped from the effluent from the polishing reactor. The product from the polishing reactor contained 14.4 ppm of total sulfur, 9.4 ppm of mercaptan sulfur (RSH), and a bromine number of 19. ASTM D-3227 method was used to measure RSH concentration in the product, and indicated a reduction of RSH by 81%.

The above results illustrate the surprising effect of recycle on the recombinant mercaptan formation. Comparative Example 2 resulted in a decrease in mercaptan sulfur content by about 81%. In contrast, the use of a 1:1 recycle dilution in Example 1 resulted in a decrease in mercaptan sulfur content by greater than 94% (actual reduction not calculable as below detection limits using ASTM D-3227).

Example 3

A gasoline product recovered from the fixed bed reactor (without recycle) was distilled into two fractions. The composition of the stripped reactor effluent, the overhead fraction, and the bottoms fraction are shown in the table below.

| Stream | Feed | Overheads | Bottoms |
|---|---|---|---|
| Wt. % of feed | 100% | 45.4% | 54.6% |
| Total S (wppm) | 12.6 | 3.5 | 18.74 |
| Bromine Number (g/100 g) | 18.5 | 36.6 | 4.8 |
| D-3710 Boiling Range | | | |
| 10% | 185 | 165 | 314 |
| 30% | 231 | 193 | 337 |
| 50% | 293 | 215 | 364 |
| 70% | 362 | 241 | 396 |
| 90% | 416 | 280 | 435 |

The data in the above table clearly shows that the Bottoms product from the distillation is higher boiling and dramatically lower in olefin concentration (as measured by the Bromine number). Although the bottoms product is higher in sulfur concentration than the overheads, the sulfur concentration is lower than that of the feed. Thus, the advantages of recycling the Bottoms back to the fixed bed reactor may be effective at reducing the overall sulfur content of the final product and diluting the olefin concentration at the reactor outlet, reducing recombinant mercaptan formation more than recycling a straight portion of the reactor product.

Example 4

Simulations were performed to predict the performance of the fixed bed reactor with different recycle streams. In case 1, the fixed bed reactor is operated with no recycle. In case 2, the fixed bed reactor is operated with recycle of product to the reactor. In case 3, only the heavy portion of the product is recycled to the reactor. In all 3 cases, the reactor is simulated at a LHSV of 10, 115 scf/bbl hydrogen, and the catalyst for the reaction is proposed to be a Co/Mo catalyst, DC-130, available from Criterion Catalyst Company. The simulation results are as follows.

| Case | 1 | 2 | 3 |
|---|---|---|---|
| Operating Temperature (° F.) | 520 | 520 | 520 |
| Operating Pressure (psia) | 255 | 254 | 204 |
| Vapor fraction in Reactor | 0.8511 | 0.849 | 0.8501 |
| Mass Ratio of Recycle to Feed | 0 | 0.487 | 0.487 |
| Feed + Recycle Sulfur (wppm) | 100 | 72.2 | 74.9 |
| Feed + Recycle Bromine Number (g/100 g) | 23 | 21.1 | 16.7 |
| Product Sulfur (wppm) | 23 | 16.6 | 14.1 |
| Sulfur as RSH (wppm) | 4.3 | 2.5 | 1.9 |
| Product Bromine Number (g/100 g) | 18.8 | 17.3 | 20.1 |

In comparing the results from the three cases, the benefits of recycling the heavy fraction of the gasoline are evident. For Case 2, recycling some of the product back to the inlet of the reactor reduces mercaptans, but it also reduces the olefin concentration in the product. The results from Case 3, however, indicate that recycling the heavier gasoline fraction saves the olefins from additional exposure to the hydrodesulfurization environment. It also allows the reactor to run at lower pressure while maintaining the same degree of vaporization. This reduces the partial pressure of hydrogen sulfide and olefins, and reduces the amount of mercaptans in the product. The net result is that recycling the heavy material improves the selectivity of the reactor as well as reduces the concentration of mercaptans in the product.

These examples demonstrate that the use of recycle material helps to dilute both the olefins and the hydrogen sulfide in the feed to the polishing reactor. Thus, recycle of stripped polishing reactor product may be very effective at reducing the recombinant mercaptans and increasing the sulfur conversion with olefinic feedstocks, allowing for the production of gasoline having less than 10 ppm sulfur.

Advantageously, embodiments disclosed herein provide for processes for the hydrodesulfurization of FCC naphtha to produce gasoline fractions having low or undetectable mercaptan content. Due to the low mercaptan content of the resulting products, embodiments disclosed herein allow for the production of very low sulfur content gasoline, such as gasoline having less than 10 ppm total sulfur, by weight.

While embodiments of processes disclosed herein have been described with respect to a limited number of embodiments, those skilled in the art, having benefit of this disclosure, will appreciate that other embodiments can be devised which do not depart from the scope of embodiments as disclosed herein. Accordingly, the scope of embodiments disclosed herein should be limited only by the attached claims.

What is claimed:

1. A process for the hydrodesulfurization of a cracked naphtha, comprising:

feeding a cracked naphtha to a fixed bed single pass reaction zone having an inlet and an outlet and containing a hydrodesulfurization catalyst, wherein a portion of the organic sulfur compounds in the cracked naphtha are reacted with hydrogen to produce $H_2S$;

recovering an effluent from the fixed bed single pass reaction zone via the outlet and feeding the effluent to a separation zone to remove $H_2S$ therefrom and to recover a stripped effluent;

analyzing the stripped effluent to determine a boiling temperature at which the stripped effluent exhibits a maximum rate of decline of bromine number on a bromine number—temperature plot;

feeding the stripped effluent to a fractionator to separate the stripped effluent into a light fraction and a heavy fraction having an ASTM D-86 initial boiling point within 30° F. of the boiling temperature at which the analysis of the stripped effluent indicates a maximum rate of decline of bromine number on a bromine number—temperature plot;

recovering the light fraction as an overheads from the fractionator;

recovering the heavy fraction as a bottoms from the fractionator;

recycling at least a portion of the heavy fraction to the fixed bed single pass reaction zone, wherein a ratio of recycled heavy fraction to the cracked naphtha fed to the fixed bed single pass reaction zone is in the range from about 0.25:1 to about 10:1.

2. The process of claim 1, wherein the stripped effluent is separated into a light fraction and a heavy fraction having an ASTM D-86 initial boiling point of at least 280° F.

3. A process for the hydrodesulfurization of a cracked naphtha stream comprising:

feeding hydrogen and a cracked naphtha stream containing organic sulfur compounds and olefins to a distillation column reactor containing a hydrodesulfurization catalyst;

concurrently in the distillation column reactor;

(1) contacting the cracked naphtha and the hydrogen with the hydrodesulfurization catalyst to react a portion of the organic sulfur compounds with the hydrogen to form $H_2S$; and (2) separating the cracked naphtha into a light fraction and a heavy fraction;

removing the light fraction as overheads from the distillation column reactor along with $H_2S$ and unreacted hydrogen;

separating the light fraction from the $H_2S$ and unreacted hydrogen;

removing the heavy fraction as bottoms from the distillation column reactor;

feeding the heavy fraction and the light fraction to a first separation zone to remove $H_2S$ therefrom and to recover a stripped combined fraction;

feeding at least a portion of the stripped combined fraction to a fixed bed single pass reaction zone having an inlet and an outlet and containing a hydrodesulfurization catalyst, wherein a portion of the remaining organic sulfur compounds in the stripped combined fraction are reacted with hydrogen to produce $H_2S$;

recovering an effluent from the fixed bed single pass reaction zone via the outlet and feeding the effluent to a second separation zone to remove $H_2S$ therefrom and to recover a stripped effluent;

analyzing the stripped effluent to determine a boiling temperature at which the stripped effluent exhibits a maximum rate of decline of bromine number on a bromine number—temperature plot;

feeding the stripped effluent to a fractionator to separate the stripped effluent into a light fraction and a heavy fraction having an ASTM D-86 initial boiling point within 30° F. of the boiling temperature at which the analysis of the stripped effluent indicates a maximum rate of decline of bromine number on a bromine number—temperature plot;

recovering the light fraction as an overheads from the fractionator;

recovering the heavy fraction as a bottoms from the fractionator;

recycling at least a portion of the heavy fraction to the fixed bed single pass reaction zone, wherein a ratio of recycled heavy fraction to the cracked naphtha fed to the fixed bed single pass reaction zone is in the range from about 0.25:1 to about 10:1.

4. The process of claim 3, wherein the stripped effluent is separated into a light fraction and a heavy fraction having an ASTM D-86 initial boiling point of at least 280° F.

5. The process of claim 3 wherein the recycled stripped effluent comprises less than 0.1 ppm $H_2S$.

6. The process of claim 3, wherein the stripped effluent comprises less than 5 ppm mercaptan, by weight.

7. The process of claim 6, wherein the stripped effluent comprises less than 1 ppm mercaptan, by weight.

8. The process of claim 3, wherein the stripped effluent comprises less than 10 ppm total sulfur, by weight.

9. The process of claim 3, further comprising combining the portion of the stripped effluent not recycled to with the portion of the stripped combined fraction not fed to the fixed bed single pass reaction zone to form a hydrodesulfurized product.

10. The process of claim 9, wherein the hydrodesulfurized product comprises less than 10 ppm total sulfur, by weight.

11. The process of claim 3, wherein the recycled stripped effluent is fed to the inlet of the fixed bed single pass reaction zone.

12. The process of claim 3, wherein the recycled stripped effluent is fed to the fixed bed single pass reaction zone intermediate the reactor inlet and reactor outlet.

13. The process of claim 3, wherein the recycled stripped effluent is fed to the fixed bed single pass reaction zone proximate the reactor outlet.

14. The process of claim 3, wherein the recycled stripped effluent is combined with the effluent proximate the outlet of the fixed bed single pass reaction zone.

15. A process for the hydrodesulfurization of a cracked naphtha stream comprising:

feeding hydrogen and a cracked naphtha stream containing organic sulfur compounds and olefins to a distillation column reactor containing a hydrodesulfurization catalyst;

concurrently in the distillation column reactor;

(1) contacting the cracked naphtha and the hydrogen with the hydrodesulfurization catalyst to react a portion of the organic sulfur compounds with the hydrogen to form $H_2S$; and (2) separating the cracked naphtha into a light fraction and a heavy fraction;

removing the light fraction as overheads from the distillation column reactor along with $H_2S$ and unreacted hydrogen;

separating the light fraction from the $H_2S$ and unreacted hydrogen;

removing the heavy fraction as bottoms from the distillation column reactor;

feeding the heavy fraction and the light fraction to a first separation zone to remove $H_2S$ therefrom and to recover a stripped combined fraction;

withdrawing a liquid fraction from the distillation column reactor as a side draw and feeding the liquid fraction to a fixed bed single pass reaction zone having an inlet and an outlet and containing a hydrodesulfurization catalyst, wherein a portion of the remaining organic sulfur compounds in the liquid fraction are reacted with hydrogen to produce $H_2S$;

recovering an effluent from the fixed bed single pass reaction zone via the outlet and feeding the effluent to a second separation zone to remove $H_2S$ therefrom and to recover a stripped effluent;

analyzing the stripped effluent to determine a boiling temperature at which the stripped effluent exhibits a maximum rate of decline of bromine number on a bromine number—temperature plot;

feeding the stripped effluent to a fractionator to separate the stripped effluent into a light fraction and a heavy fraction having an ASTM D-86 initial boiling point within 30° F. of the boiling temperature, at which the analysis of the stripped effluent indicates a maximum rate of decline of bromine number on a bromine number—temperature plot;

recovering the light fraction as an overheads from the fractionator;

recovering the heavy fraction as a bottoms from the fractionator;

recycling at least a portion of the heavy fraction to the fixed bed single pass reaction zone, wherein a ratio of recycled heavy fraction to the cracked naphtha fed to the fixed bed single pass reaction zone is in the range from about 0.25:1 to about 10:1.

16. The process of claim 15, wherein the stripped effluent is separated into a light fraction and a heavy fraction having an ASTM D-86 initial boiling point of at least 280° F.

17. The process of claim 15, wherein the recycled stripped effluent comprises less than 0.1 ppm $H_2S$.

18. The process of claim 15, wherein the stripped effluent comprises less than 5 ppm mercaptan, by weight.

19. The process of claim 18, wherein the stripped effluent comprises less than 1 ppm mercaptan, by weight.

20. The process of claim 15, wherein the stripped effluent comprises less than 10 ppm total sulfur, by weight.

21. The process of claim 15, further comprising combining the portion of the stripped effluent not recycled with the stripped combined fraction as a hydrodesulfurized product.

22. The process of claim 21, wherein the hydrodesulfurized product comprises less than 10 ppm total sulfur, by weight.

23. The process of claim 15, wherein the recycled stripped effluent is fed to the inlet of the fixed bed single pass reaction zone.

24. The process of claim 15, wherein the recycled stripped effluent is fed to the fixed bed single pass reaction zone intermediate the reactor inlet and reactor outlet.

25. The process of claim 15, wherein the recycled stripped effluent is fed to the fixed bed single pass reaction zone proximate the reactor outlet.

26. The process of claim 15, wherein the recycled stripped effluent is combined with the effluent proximate the outlet of the fixed bed single pass reaction zone.

27. A process for the hydrodesulfurization of a cracked naptha comprising the steps of:

feeding (1) a full boiling range cracked naphtha containing olefins, diolefins, mercaptans and other organic sulfur compounds and (2) hydrogen to a first catalytic distillation reactor system;

concurrently in the first catalytic distillation reactor system, (i) contacting the diolefins and the mercaptans in the cracked naphtha in the presence of a Group VIII metal catalyst in the rectification section of the first catalytic distillation reactor system thereby reacting:

(A) a portion of the mercaptans with a portion of the diolefins to form thioethers, (B) a portion of the mercaptans with a portion of the hydrogen to form hydrogen sulfide; or (C) a portion of the dienes with a portion of the hydrogen to form olefins; or (D) a combination of one or more of (A), (B), and (C); and (ii) fractionating the full boiling range cracked naphtha into a distillate product containing C5 hydrocarbons and a first heavy naphtha containing sulfur compounds;

recovering the first heavy naphtha from the first catalytic distillation reactor system as a first bottoms;

feeding the first bottoms and hydrogen to a second catalytic distillation reactor system having one or more reaction zones containing a hydrodesulfurization catalyst;

concurrently in the second catalytic distillation reactor system, (i) reacting at least a portion of the mercaptans and other organic sulfur compounds in the first bottoms with hydrogen in the presence of the hydrodesulfurization catalyst to convert a portion of the mercaptans and other organic sulfur compounds to hydrogen sulfide, and (ii) separating the first bottoms into a light naphtha fraction and a heavy naphtha fraction;

recovering the light naphtha fraction, unreacted hydrogen, and hydrogen sulfide from the second catalytic distillation reactor system as an overheads vapor fraction;

separating the light naphtha fraction from the $H_2S$ and unreacted hydrogen;

recovering the heavy naphtha fraction from the second catalytic distillation reactor system as a bottoms fraction;

feeding the heavy naphtha fraction and the light naphtha fraction to a first separation zone to remove $H_2S$ therefrom and to recover a stripped combined fraction;

feeding at least a portion of the stripped combined fraction to a fixed bed single pass reaction zone having an inlet and an outlet and containing a hydrodesulfurization catalyst, wherein a portion of the remaining organic sulfur compounds in the stripped combined fraction are reacted with hydrogen to produce $H_2S$;

recovering an effluent from the fixed bed single pass reaction zone via the outlet and feeding the effluent to a second separation zone to remove $H_2S$ therefrom and to recover a stripped effluent;

analyzing the stripped effluent to determine a boiling temperature at which the stripped effluent exhibits a maximum rate of decline of bromine number on a bromine number—temperature plot; and feeding the stripped effluent to a fractionator to separate the stripped effluent into a light fraction and a heavy fraction having an ASTM D-86 initial boiling point within 30° F. of the boiling temperature at which the analysis of the stripped effluent indicates a maximum rate of decline of bromine number on a bromine number—temperature plot;

recovering the light fraction as an overheads from the fractionator;

recovering the heavy fraction as a bottoms from the fractionator;

recycling at least a portion of the heavy fraction to the fixed bed single pass reaction zone, wherein a ratio of recycled heavy fraction to the cracked naphtha fed to the fixed bed single pass reaction zone is in the range from about 0.25:1 to about 10:1.

28. A process for the hydrodesulfurization of a cracked naptha comprising the steps of:

feeding (1) a light cracked naphtha containing olefins, diolefins, mercaptans and other organic sulfur compounds and (2) hydrogen to a first catalytic distillation reactor system;

concurrently in the first catalytic distillation reactor system, (i) contacting the diolefins and the mercaptans in the light cracked naphtha in the presence of a Group VIII metal catalyst in the rectification section of the first catalytic distillation reactor system thereby reacting:

(A) a portion of the mercaptans with a portion of the diolefins to form thioethers, (B) a portion of the mercaptans with a portion of the hydrogen to form hydrogen sulfide; or (C) a portion of the dienes with a portion of the hydrogen to form olefins; or (D) a combination of one or more of (A), (B), and (C); and (ii) fractionating the light cracked naphtha into a distillate product containing C5 hydrocarbons and a first heavy naphtha containing sulfur compounds;

recovering the first heavy naphtha from the first catalytic distillation reactor system as a first bottoms;

feeding the first bottoms, at least one of an intermediate cracked naphtha and a heavy cracked naphtha, and hydrogen to a second catalytic distillation reactor system having one or more reaction zones containing a hydrodesulfurization catalyst;

concurrently in the second catalytic distillation reactor system, (i) reacting at least a portion of the mercaptans and other organic sulfur compounds in the fed first bottoms, intermediate cracked naphtha, and heavy cracked naphtha with hydrogen in the presence of the hydrodesulfurization catalyst to convert a portion of the mercaptans and other organic sulfur compounds to hydrogen sulfide, and (ii) separating the fed first bottoms, intermediate cracked naphtha, and heavy cracked naphtha into a light naphtha fraction and a heavy naphtha fraction;

recovering the light naphtha fraction, unreacted hydrogen, and hydrogen sulfide from the second catalytic distillation reactor system as an overheads vapor fraction;

separating the light naphtha fraction from the $H_2S$ and unreacted hydrogen;

recovering the heavy naphtha fraction from the second catalytic distillation reactor system as a bottoms fraction;

feeding the heavy naphtha fraction and the light naphtha fraction to a first separation zone to remove $H_2S$ therefrom and to recover a stripped combined fraction;

feeding at least a portion of the stripped combined fraction to a fixed bed single pass reaction zone having an inlet and an outlet and containing a hydrodesulfurization catalyst, wherein a portion of the remaining organic sulfur compounds in the stripped combined fraction are reacted with hydrogen to produce $H_2S$;

recovering an effluent from the fixed bed single pass reaction zone via the outlet and feeding the effluent to a second separation zone to remove $H_2S$ therefrom and to recover a stripped effluent;

analyzing the stripped effluent to determine a boiling temperature at which the stripped effluent exhibits a maximum rate of decline of bromine number on a bromine number—temperature plot; and feeding the stripped effluent to a fractionator to separate the stripped effluent into a light fraction and a heavy fraction having an ASTM D-86 initial boiling point within 30° F. of the boiling temperature at which the analysis of the stripped effluent indicates a maximum rate of decline of bromine number on a bromine number—temperature plot;

recovering the light fraction as an overheads from the fractionator;

recovering the heavy fraction as a bottoms from the fractionator;

recycling at least a portion of the heavy fraction to the fixed bed single pass reaction zone, wherein a ratio of recycled heavy fraction to the cracked naphtha fed to the fixed bed single pass reaction zone is in the range from about 0.25:1 to about 10:1.

* * * * *